United States Patent [19]

Hirano et al.

[11] Patent Number: 4,719,174

[45] Date of Patent: Jan. 12, 1988

[54] DIRECT POSITIVE SILVER HALIDE PHOTOGRAPHIC LIGHT-SENSITIVE MATERIAL DEPRESS FORMATION OF RE-REVERSED NEGATIVE IMAGE

[75] Inventors: Shigeo Hirano; Tsutomu Miyasaka; Shinsaku Fujita, all of Kanagawa, Japan

[73] Assignee: Fuji Photo Film Co., Ltd., Kanagawa, Japan

[21] Appl. No.: 847,144

[22] Filed: Apr. 2, 1986

Related U.S. Application Data

[63] Continuation of Ser. No. 621,654, Jun. 18, 1984, abandoned.

[30] Foreign Application Priority Data

Jun. 17, 1983 [JP] Japan ..... 58-108693

[51] Int. Cl.[4] ..... G03C 1/485; G03C 1/34

[52] U.S. Cl. ..... 430/409; 430/567; 430/611; 430/612; 430/613; 430/614; 430/598

[58] Field of Search ..... 430/611, 612, 613, 614, 430/940, 596, 598, 409, 567

[56] References Cited

U.S. PATENT DOCUMENTS

| | | | |
|---|---|---|---|
| 3,713,832 | 1/1973 | Shiba et al. | 430/940 |
| 4,266,018 | 5/1981 | Ishiguro et al. | 430/611 |
| 4,395,478 | 7/1983 | Hoyen | 430/598 |
| 4,471,044 | 9/1984 | Parton et al. | 430/598 |
| 4,478,928 | 10/1984 | Hess et al. | 430/598 |
| 4,481,285 | 11/1984 | Takagi et al. | 430/940 |
| 4,629,678 | 12/1986 | Murai | 430/598 |

FOREIGN PATENT DOCUMENTS 60-73625 4/1985 Japan .

*Primary Examiner*—Won H. Louie

*Attorney, Agent, or Firm*—Sughrue, Mion, Zinn, Macpeak, and Seas

[57] ABSTRACT

A direct positive silver halide photographic light-sensitive material is described containing a weak electron donative, adsorptive compound represented by formula (I) or (II) effective for depressing formation of a re-reversed negative image, which is not a spectral sensitizing agent for silver halide or a nucleating agent:

D—L—X (I)

D—X (II)

wherein

D represents electron donative atoms comprising an aromatic ring or hereto ring, which is unsubstituted or substituted;

L represents a linking group containing at least one of C, N, S and O and an atom or atoms necessary for cutting a $\pi$-conjunction system; and X represents a group which is adsorptive with respect to silver halide and contains at least one of C, N, S, O and Se.

17 Claims, 2 Drawing Figures

DIRECT POSITIVE SILVER HALIDE PHOTOGRAPHIC LIGHT-SENSITIVE MATERIAL DEPRESS FORMATION OF RE-REVERSED NEGATIVE IMAGE

This is a continuation of application Ser. No. 621,654, filed June 18, 1984, now abandoned.

FIELD OF THE INVENTION

This invention relates to a direct positive silver halide photographic light-sensitive material and, more particularly, to a direct positive silver halide photographic light-sensitive material which contains in its light-sensitive layer or layers a compound or compounds effective for depressing formation of undesired re-reversed negative image. In addition, the present invention relates to a method for depressing formation of such re-reversed negative image.

BACKGROUND OF THE INVENTION

In the field of silver halide photography, photographic processes for obtaining a positive photographic image without reversal processing for forming positive image is called a direct positive photographic process, and photographic light-sensitive materials for such process are called direct positive photographic light-sensitive materials. Direct positive photographic processes include various types: one type is a process of exposing previously surface-fogged silver halide grains in the presence of a desensitizer and conducting development processing; another type is a process of exposing a silver halide emulsion containing light-sensitive nuclei mainly within silver halide grains and conducting surface development in the presence of a nucleating agent or after overall uniform exposure. The present invention mainly relates to the latter type process.

Silver halide emulsions containing light-sensitive nuclei within silver halide grains, and therefore forming latent image mainly within the grains, are called "internal latent image-forming type" emulsions, and are essentially different from ordinary silver halide emulsions forming latent image mainly on the surface of grains.

In the internal latent image-forming silver halide emulsions, exposed grains do not substantially undergo surface development, since the latent image formed within the grains takes electrons of the nucleating agent into the interior portion of the grains. On the other hand, unexposed grains form a latent image (fogging nuclei) on their surface due to donation of electrons from the nucleating agent, becoming surface-developable. Thus, a direct positive imge is formed by surface nucleation development after imagewise exposure.

The above-described process for obtaining a direct positive image according to surface nucleation development must provide acceptable fundamental photographic properties such as with respect to photographic sensitivity, increased maximum density ($D_{max}$), and decreased minimum density ($D_{min}$) for the process to be put into use in practical photographic applications, and many patents and applications as described hereinafter have been published and laid open, respectively, describing various embodiments and improvements of photographic factors such as emulsion composition, sensitizing agent, nucleating agent, etc. However, formation of re-reversed negative image, which is a defect with conventional direct positive emulsions, has been an unsolved problem, even though it is a serious problem causing deterioration of image quality. For example, Japanese Patent Application (OPI) No. 66727/78 (the term "OPI" as used herein refers to a "published unexamined Japanese patent application") discloses a method for depressing formation of re-reversed negative image, which method is not adequate for solving the above problem. This formation of re-reversed negative image, characteristic of internal latent image-forming emulsions, is particularly serious when light-sensitive materials are exposed with high illuminance, particularly when exposed to sunlight or reflection light from a stroboscope, and a negative image is printed out as blackish brown spots on the light-sensitive film. Thus, effective techniques which depress formation of the re-reversed negative image upon high illuminance exposure, would be highly desirable.

SUMMARY OF THE INVENTION

An object of the present invention is to provide a direct positive silver halide photographic light-sensitive material having substantially improved photographic properties by depressing formation of the above-described re-reversed negative image upon high illuminance exposure, and to provide a method for depressing formation of the re-reversed negative image.

More particularly, an object of the present invention is to provide a direct positive silver halide photographic light-sensitive material for a photographic process of obtaining a direct positive image by surface-developing an internal latent image-forming silver halide photographic emulsion in the presence of a nucleating agent, which material is designed to depress formation of re-reversed negative image (or, in other words, to desensitize the re-reversed negative image), thus providing a direct positive image showing a practical improved image quality and good maximum density and minimum density, and which permits accelerated development.

The above-described objects of the present invention can be attained by incorporating in a direct positive silver halide photographic light-sensitive material a weak electron donative, adsorptive compound represented by formula (I) or (II) effective for depressing formation of a re-reversed negative image, which is not a spectral sensitizing dye for silver halide or a nucleating agent:

$$D—L—X \quad (I)$$

$$D—X \quad (II)$$

wherein

D represents electron donative atoms comprising an aromatic ring or a hetero ring which is unsubstituted or substituted with one or more substituents;

L represents a linking group containing at least one of C, N, S, and O and an atom or atoms necessary for cutting the $\pi$-conjugation system; and X represents a group which is adsorptive with respect to silver halide and contains at least one of C, N, S, O, and Se, with N being optionally quaternized.

DETAILED DESCRIPTION OF THE INVENTION

The inventors have postulated a principle of formation for the re-reversed negative image as described below, and based thereon have found a reaction principle for depressing the negative image and have found the essential properties required for a negative image-depressing agent.

Figure 1:
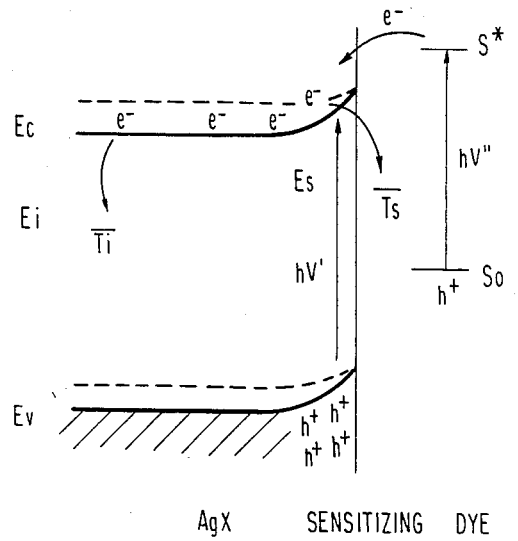
FIG. 1 schematically illustrates the mechanism of formation of a re-reversed negative image.

Principle of Formation of Re-reversed Negative Image:

FIG. 1 schematically shows a band structure of an internal latent image-forming silver halide crystal and an energy level of sensitizing dye, wherein Ec represents a conduction band level, Ev represents a valence band level, Ei represents a level of electron trap which becomes a nucleus for forming latent image within the crystal, Es represents a level of electron trap which becomes a nucleus for forming negative image on the surface of crystal, $S_o$ and $S^*$ represent donor levels of a sensitizing dye in the ground state and in an excited state, respectively, $e^-$ and $h^+$ represent excited electrons and positive holes, respectively, and $h\nu'$ and $h\nu''$ each represents an energy of exposure light.

Upon exposure of silver halide (AgX), exposure with light of the intrinsic region excites electrons on the surface of silver halide grains to a conduction band to produce positive holes, whereas exposure with light of spectrally sensitized (color-sensitized) region, causes injection of excited electrons of the adsorbing dye into a conduction band to produce positive holes of dye on the surface of silver halide grains. Electrons in a conduction band in turn diffuse into the crystal bulk along the slope of the potential bending in a certain short time (generally not longer than $10^{-6}$ second) and are caught by electron traps (Ti) existing within the silver halide grains to form internal latent image nuclei. This process is a latent image-forming process which normally proceeds when the exposure is conducted with ordinary exposure intensity within a not so intense range.

However, this process changes when silver halide is exposed to light of high intensity to form many excited electrons and positive holes in a relatively short time period. In this case, many electrons are injected into the conduction band, faster than diffusion of the excited electrons into the interior of silver halide grains and trapping thereof can occur. As a result, instant photoelectrons accumulate in the conduction band to reduce the degree of bending of the band (as shown by dashed line in FIG. 1), whereby diffusion of photoelectrons into the interior is restrained. Further, the number of positive holes produced on the surface function to depress migration of the photoelectrons into the interior of the grains due to the electric field the holes produce. Under such situation, the photoelectrons recombine with positive holes near the surface, or are caught by a certain traps (Ts) on the surface within their lives; thus, the probability of forming surface latent image nuclei becomes high. In such a case, the surface latent image nuclei provide a silver image upon surface development, and hence the so-called re-reversed negative image is formed on the surface of silver halide grains by the high illuminance exposure as described above.

Principle of Depressing Formation of Negative Image:

In the above-described process of forming a re-reversed negative image, the existence of bulk positive holes attracting electrons in the conduction band to the surface and reverse diffusion of photoelectrons to the surface due to reduction of the bending degree of the band are considered to be the main causes of producing surface negative latent image nuclei. One means for depressing these phenomena is to add to the system a compound which can neutralize the above-described positive holes and effectively trap photoelectrons diffusing to the surface to produce surface latent image nuclei.

Figure 2:
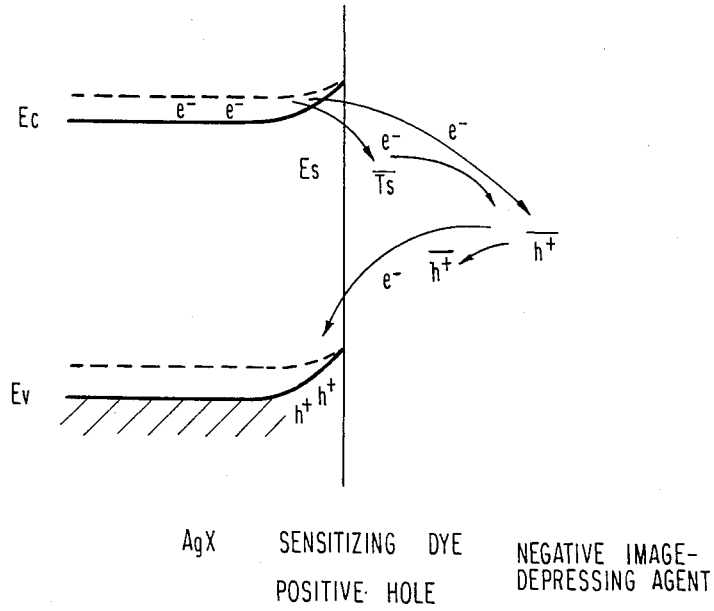
FIG. 2 schematically illustrates the mechanism showing how a compound of the present invention depresses formation of a re-reversed negative image.

FIG. 2 schematically shows the principle and mechanism of depressing negative image formation with such a compound. The compound is an electron donative compound. First, it provides electrons to the positive holes of the silver halide or sensitizing dye to reductively neutralize them. The resulting positive holes of the compound (i.e., the oxidation product radical) have a somewhat long life, during which it traps photoelectrons having reversely diffused to the surface of silver halide or photoelectrons having been caught by the surface trap (Ts) to thereby prevent formation of surface latent image nuclei. In order to depress formation of the negative image according to the above-described mechanism, the compound is required to satisfy the following conditions:

(1) the compound must be electron donative, and possess an oxidation potential less noble than the valence band level of the silver halide and the positive hole level (i.e., the oxidation potential) of the sensitizing dye;

(2) the compound must have an oxidation potential (positive hole level) nobler than the surface trap level, Es, for bleaching the surface latent image nuclei;

(3) the compound must produce comparatively stable positive holes (i.e., to produce long-life positive holes); and (4) the compound must be a type which is adsorbed on the surface of silver halide.

In the compounds of formulae (I) and (II), which satisfy the noted conditions, the aromatic ring or hetero ring constituting the electron donative atoms represented by D may be a single ring or a fused ring between aromatic rings, between hetero rings, or between an aromatic ring(s) and a hetero ring(s). The number of fused rings is, for example, 2 to 6. The hetero ring contains at least one of N, O, S and Se as a hetero atom. The aromatic or hetero ring is preferably a 5- or 6-membered ring. The atoms represented by D may be derived from a metal salt or a metal complex.

The linking group represented by L is preferably an organic linking group, more specifically an alkylene group, an alkenylene group, an arylene group, —O—, —S—, —CO—, —NH—, —N= (these being optionally substituted), alone or in combination.

X is derived, for example, from the following compounds: thioureas, thioamides, mercapto-substituted hetero ring compounds (e.g., mercaptotetrazole, mercaptotriazole, mercaptothiadiazole, mercaptoimidazole, mercaptooxadiazole, mercaptothiazole, mercaptobenzimidazole, mercaptobenzothiazole, mercaptobenzoxazole, mercaptopyrimidine, mercaptotriazine, etc.), benzotriazoles, thiosemicarbazides, rhodanines, thiohydantoins, thiobarbituric acids, etc. Furthermore, examples of quaternized N are illustrated by compounds such as benzothiazole, benzimidazole, benzoxazole, benzoselenazole, thiazole, oxazole, selenazole, imidazole, pyridine, quinoline, etc., wherein the nitrogen atom is quaternized. X may also be a simple mercapto group.

Particularly preferred examples of X are a mercapto group and those groups which are derived from thioureas, thioamides, thiosemicarbazides, and mercaptosubstituted hetero ring compounds.

More preferable examples are those groups which are derived from thioureas, thiosemicarbazides, and mercaptothiadiazoles, with those derived from thioureas being most preferable.

Examples of groups derived from thioureas include those represented by the formula $$-NR_1\underset{\underset{S}{\|}}{C}NR_2R_3$$

wherein $R_1$, $R_2$ and $R_3$, which may be the same or different, each represents an alkyl group (e.g., a methyl group, an ethyl group, etc.), an aryl group (e.g., a phenyl group, a naphthyl group, etc.), or a hetero ring group (e.g., a 5-7-membered ring containing N, O, S, Se or the like as a hetero atom), with at least one of $R_1$, $R_2$ and $R_3$ being a hydrogen atom.

The groups represented by $R_1$ to $R_3$ may further be substituted. Examples of the substituent for the aryl or hetero ring group include a halogen atom, an alkyl group, an alkoxy group, an acylamino group, etc., and examples of the substituent for the alkyl group include a halogen atom, an alkoxy group, an alkoxycarbonyl group, an alkylthio group, an amino group, a cyano group, etc.

Specific skeleton examples of electron donative atoms represented by D are as follows, and D is derived from these skeletons. In the compounds represented by formulae (I) and (II), these skeletons can be linked to the group L or X at any possible position of these skeletons.

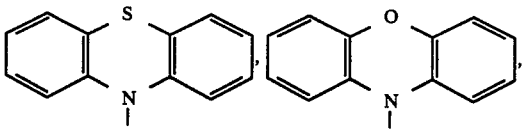

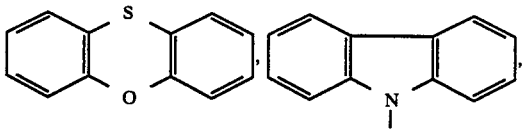

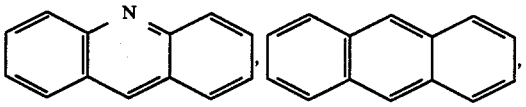

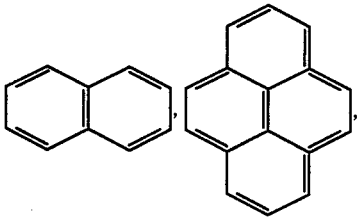

-continued

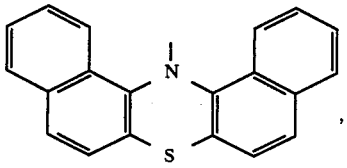

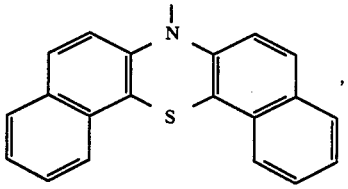

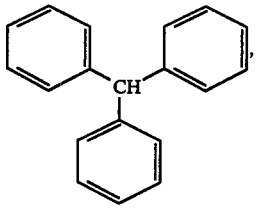

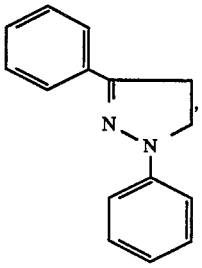

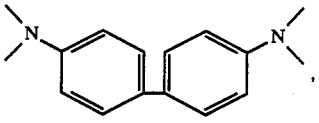

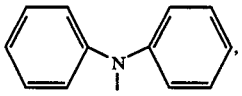

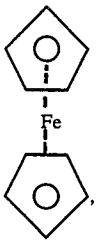

$[Ru(bipyridyl)_3]^{2+}$,

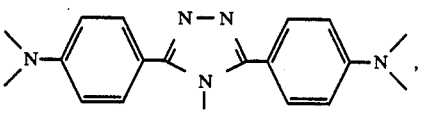

-continued

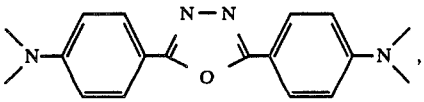

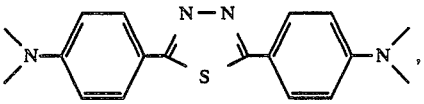

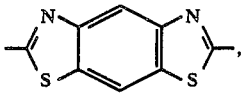

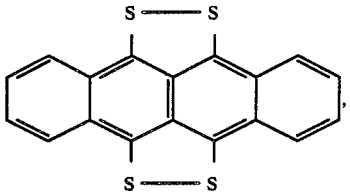

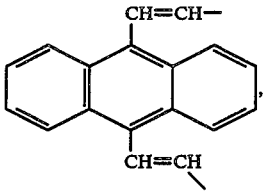

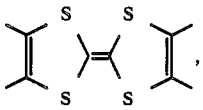

-continued

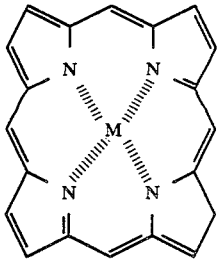

(In the above formula, M represents a heavy metal such as Zn, Pd, Cu, Ni or Fe.)

The above-illustrated electron-donative skeletons may be substituted, for example, by the following substituents (which may further be substituted): an amino group, an alkoxy group, a hydroxy group, an alkyl group, an aryl group, an aryloxy group, an alkylthio group, an arylthio group, a halogen atom, an acylamino group, an acyloxy group, a sulfonylamino group, a carbamoyl group, a sulfamoyl group, an alkoxycarbonyl group, a ureido group, a cyano group, etc.

The compounds represented by formulae (I) and (II) have comparatively weak electron donative properties. More specifically, the oxidation potential of compounds of formulae (I) and (II) or that of the electron donative atoms represented by D in formulae (I) and (II) preferably is in the range of from 0 to +1.0 V with respect to a saturated calomel electrode, and more preferably from 0.4 to 0.7 V. The oxidation potential can be measured by using 0.1M sodium perchlorate as supporting electrolyte and conducting electrolytic oxidation in a mixture solution of acetonitrile/methanol (volume ratio: 15/1) (concentration: about $10^{-3}$ mol/liter) using a rotating platinum disk electrode (750 rpm).

The above-described compounds are preferably used in amounts of from $10^{-6}$ to $10^{-2}$ mol, and more preferably from $10^{-5}$ to $10^{-3}$ mol, per mol of silver halide in an emulsion layer associated therewith.

Specific examples of the compounds of formulae (I) and (II) to be used in the present invention are illustrated below; however, these examples are not intended to limit the present invention in any way.

1.

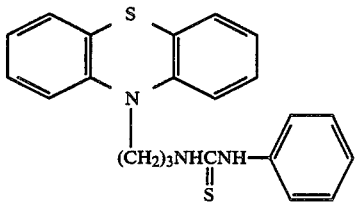

2.

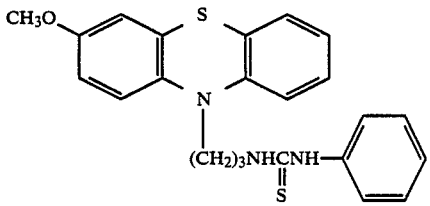

3.

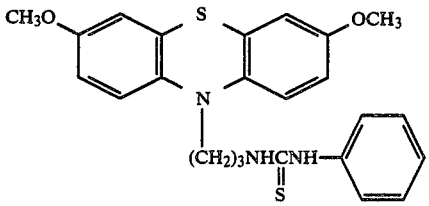

4.

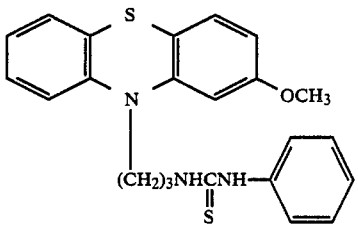

-continued
5.
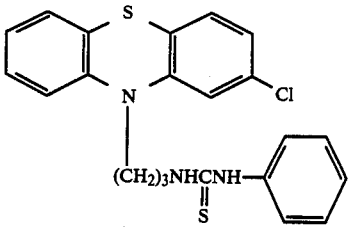
6.
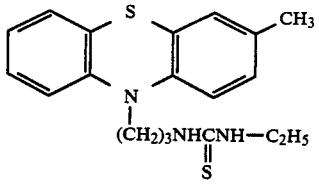
7.
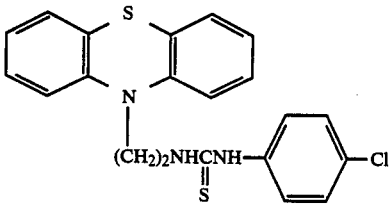
8.
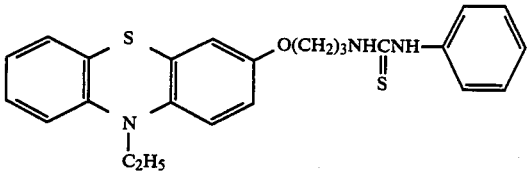
9.
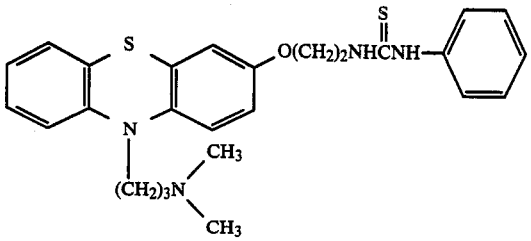
10.
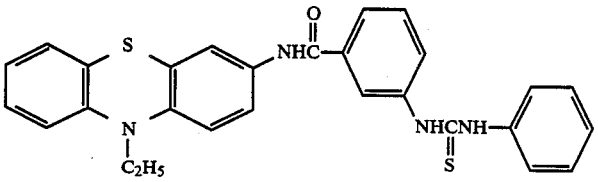
11.
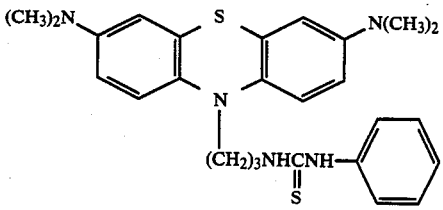
12.
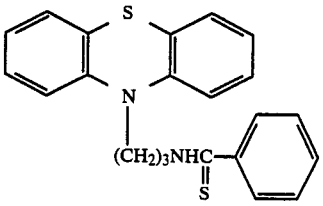
13.
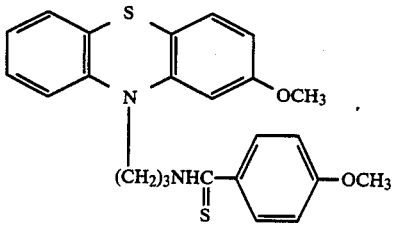
14.
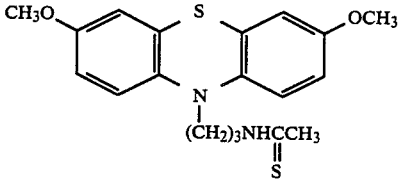
15.
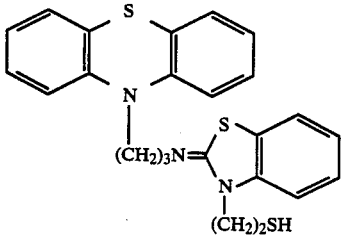
16.
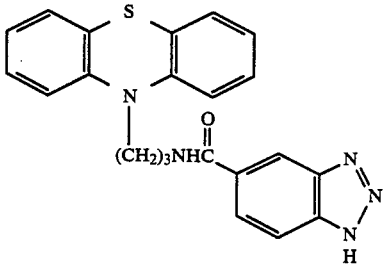

-continued
17.
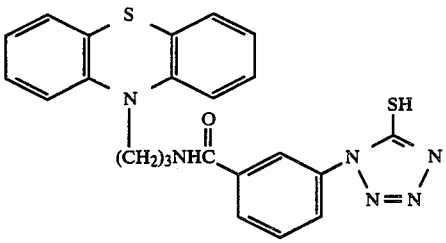
18.
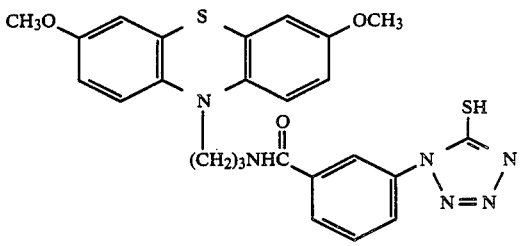
19.
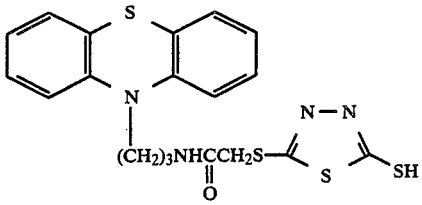
20.
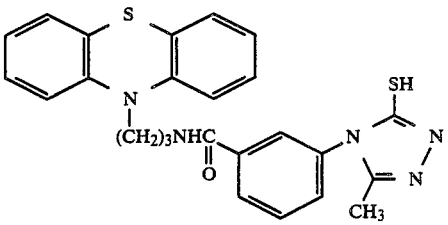
21.
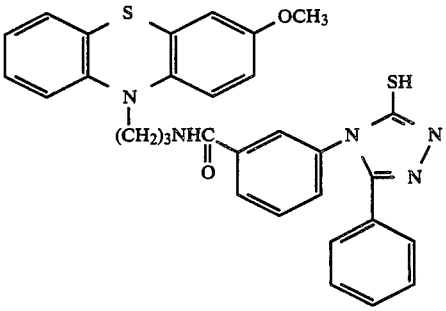
22.
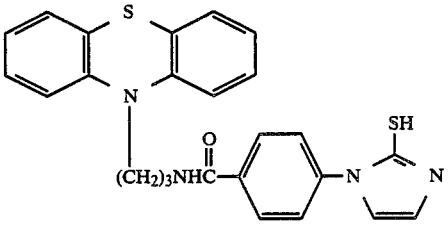
23.
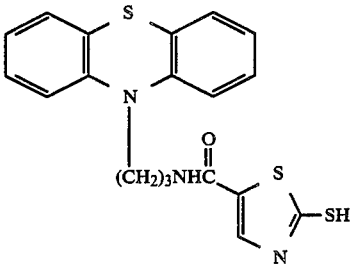
24.
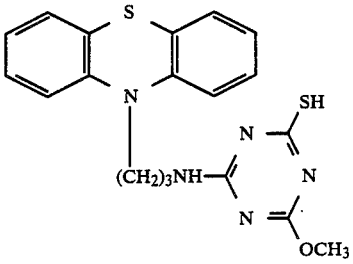
25.
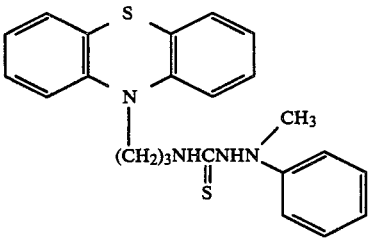
26.
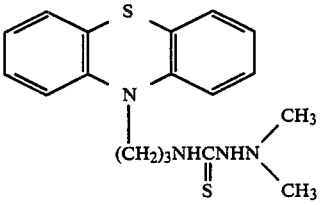
27.
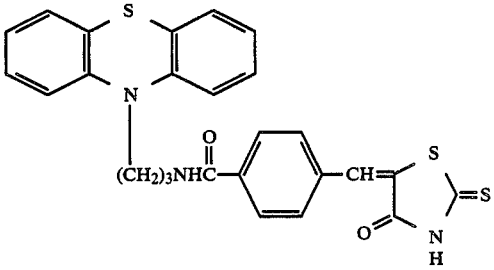
28.
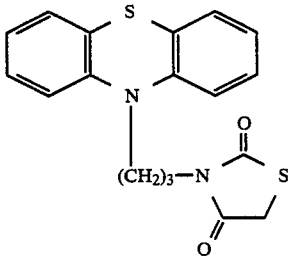

-continued
29.
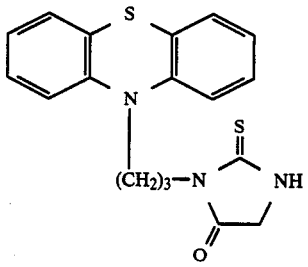
30.
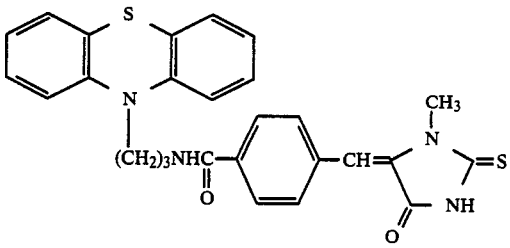
31.
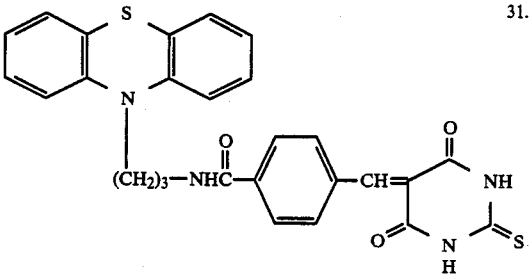
32.
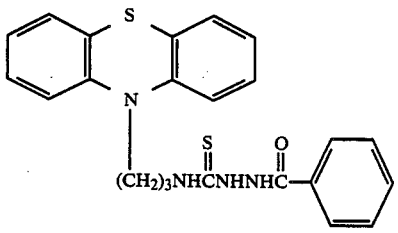
33.
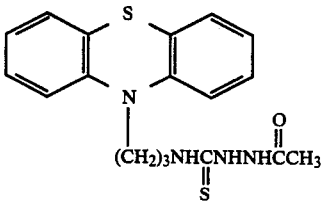
34.
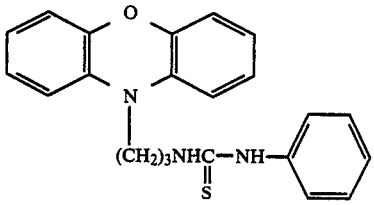
35.
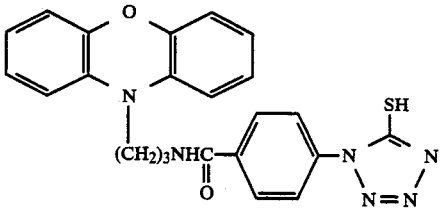
36.
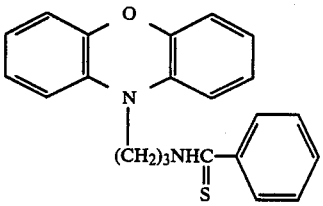
37.
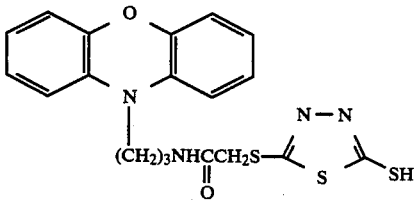
38.
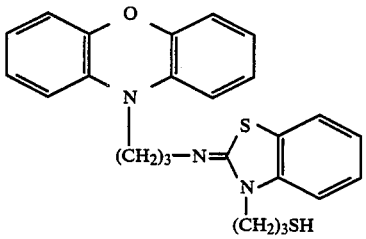
39.
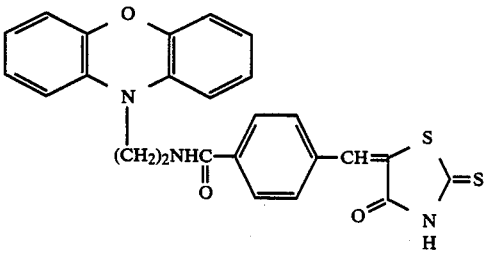
40.
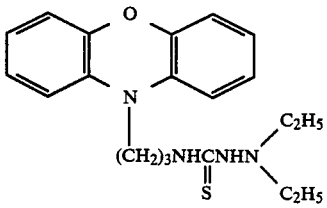

-continued
41.
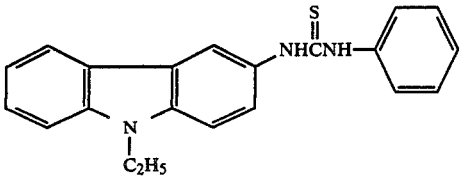
42.
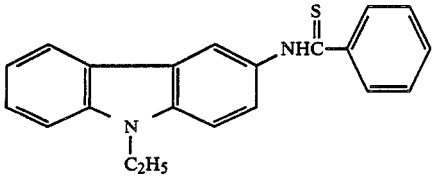
43.
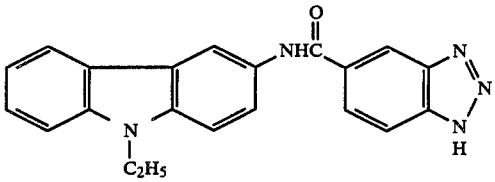
44.
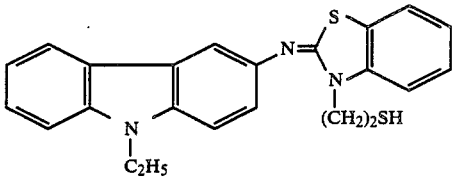
45.
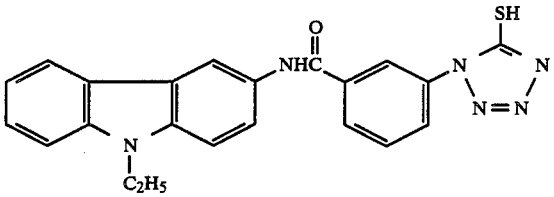
46.
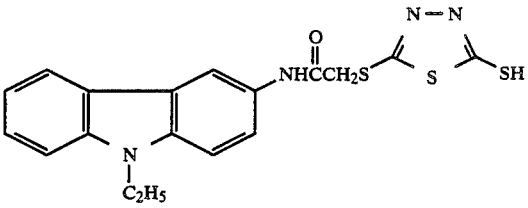
47.
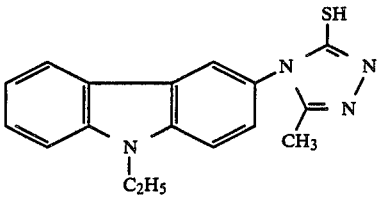
48.
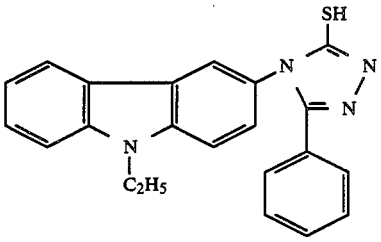
49.
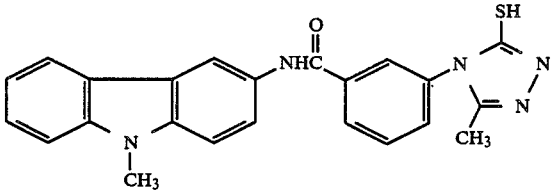
50.
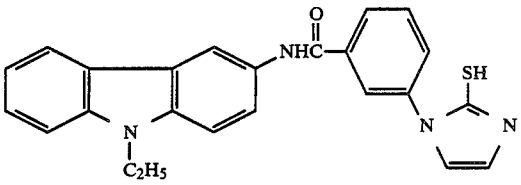
51.
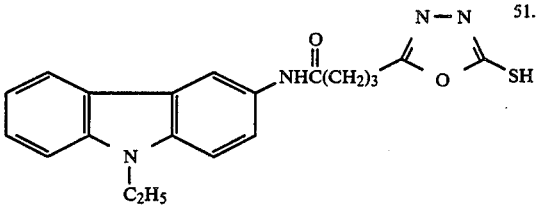
52.
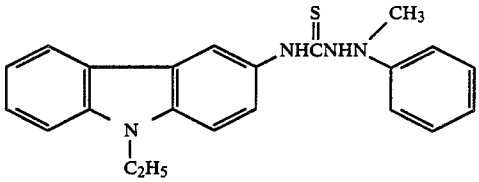
53.
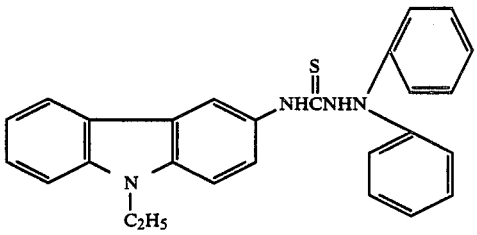
54.
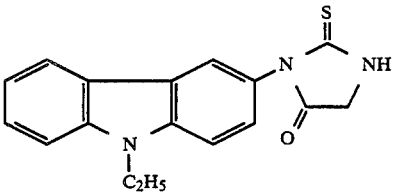

-continued
55.
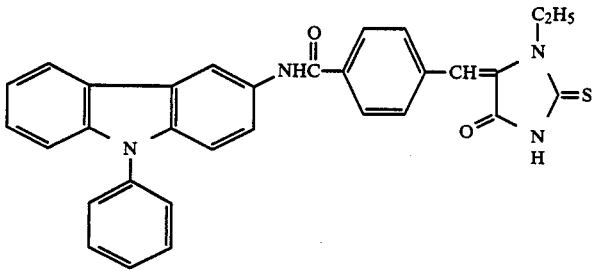
56.
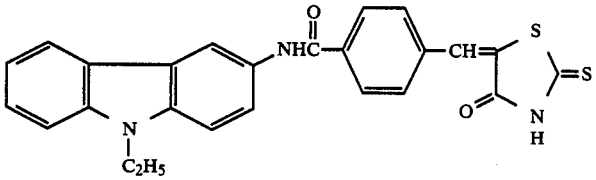
57.
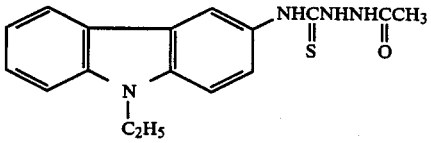
58.
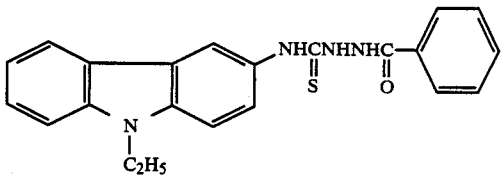
59.
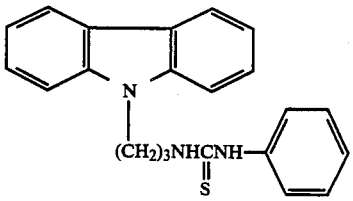
60.
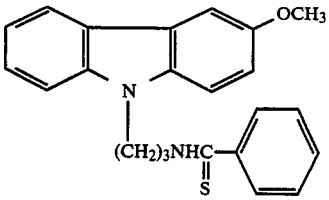
61.
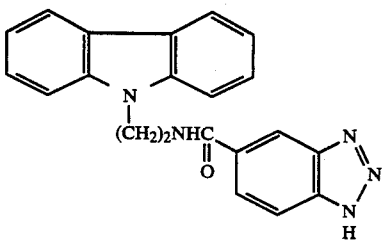
62.
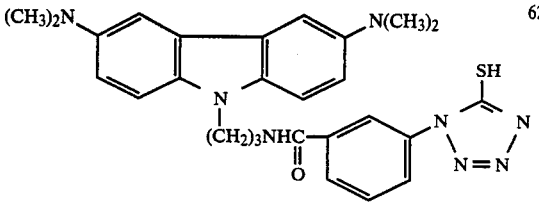
63.
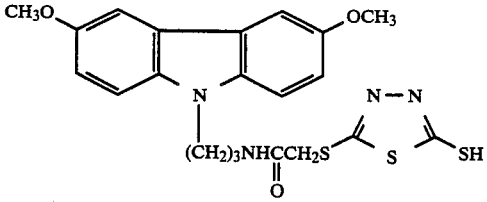
64.
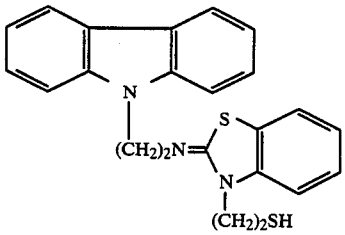
65.
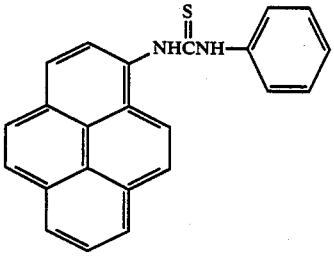
66.
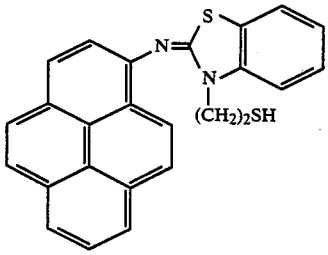

-continued
67.
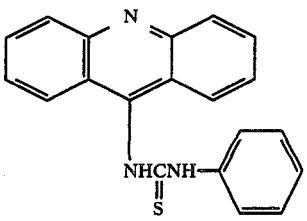
68.
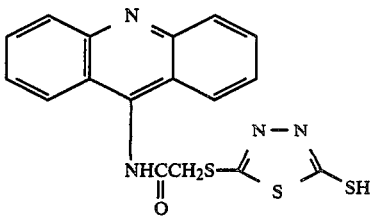
69.
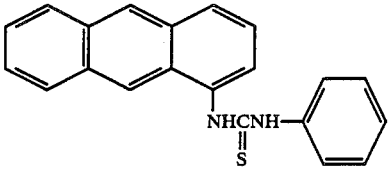
70.
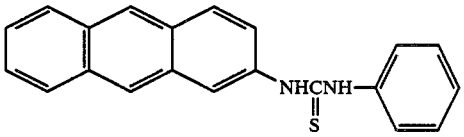
71.
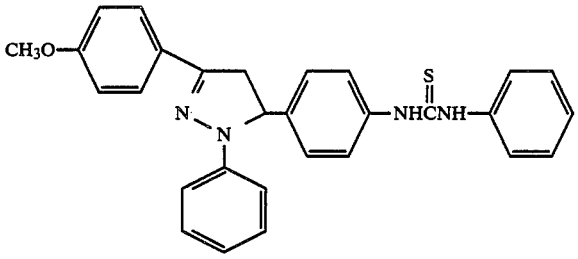
72.
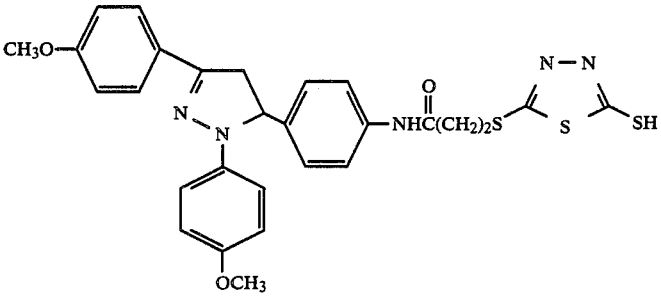
73.
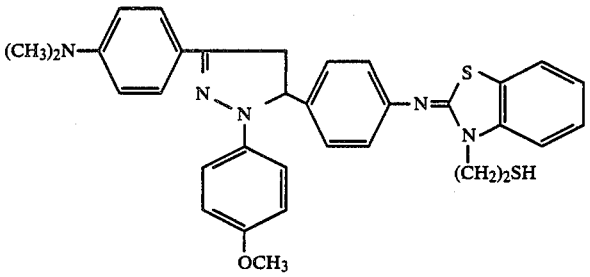
74.
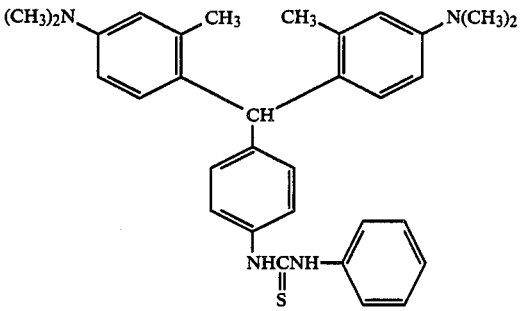
75.
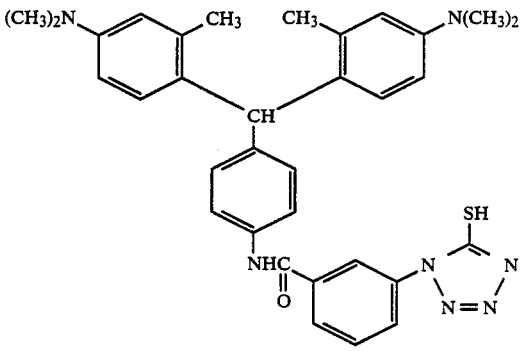

-continued
76.
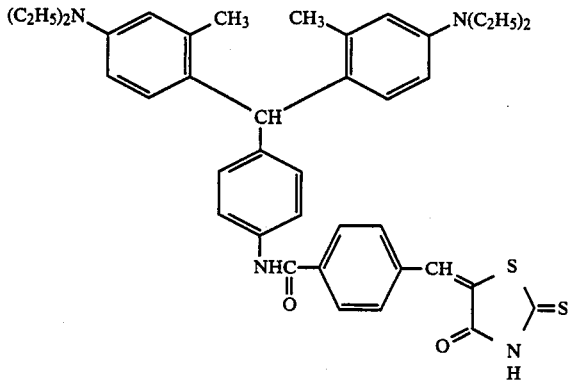
77.
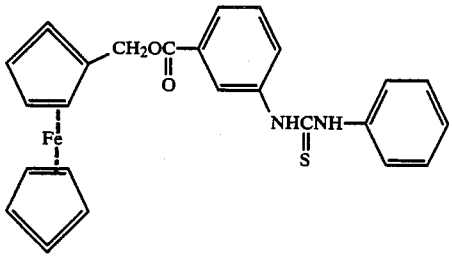
78.
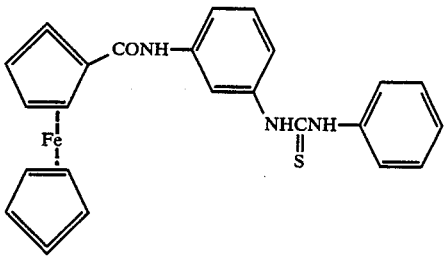
79.
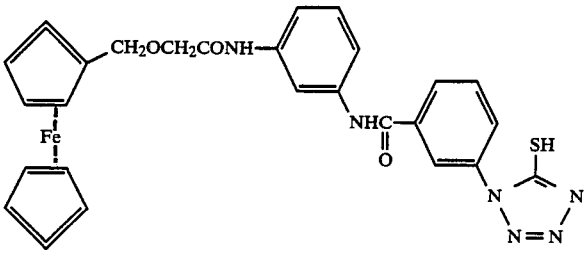
80.
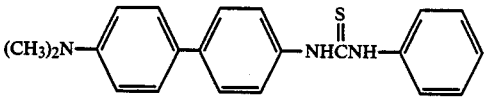
81.
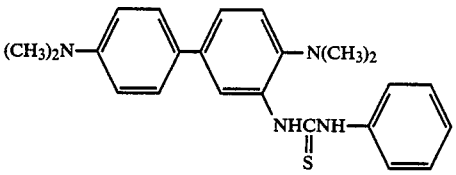
82.
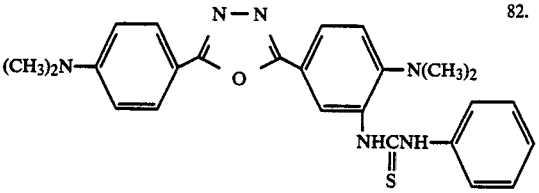
83.
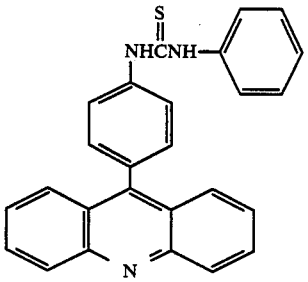

-continued
84.
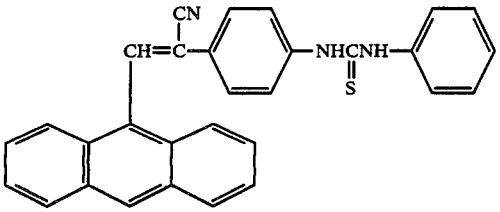
85.
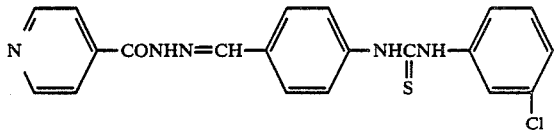
86.
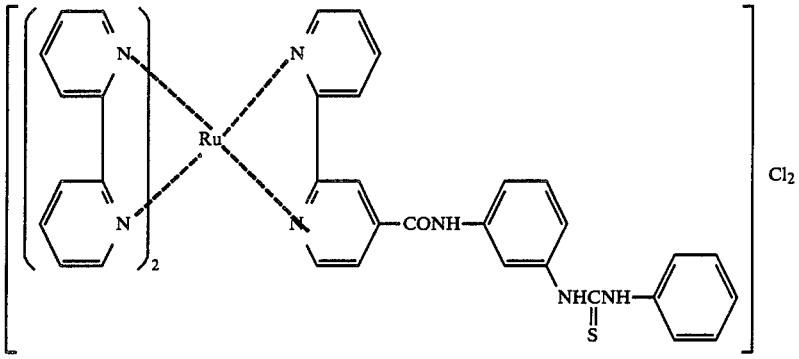
87.
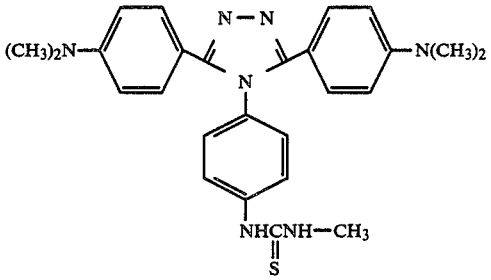
88.
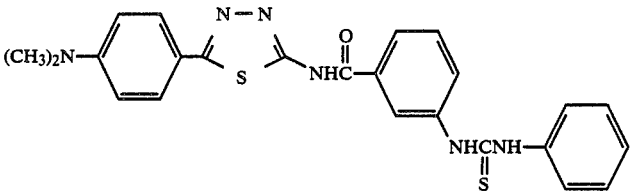
89.
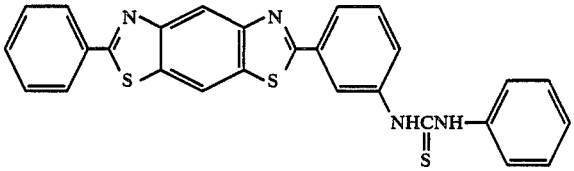
90.
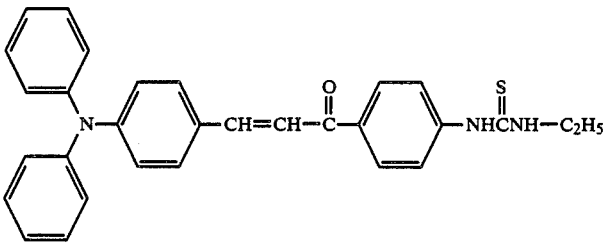

-continued

91.

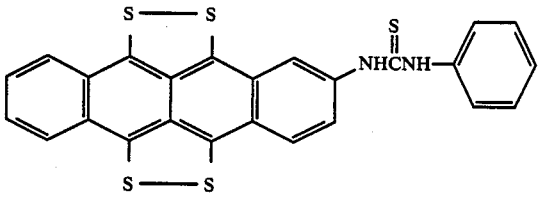

92.

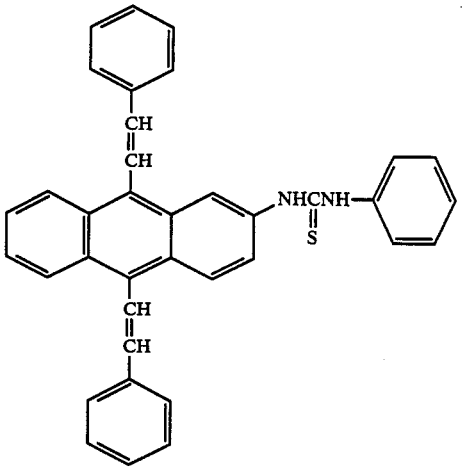

93.

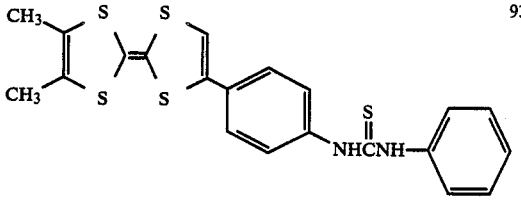

94.

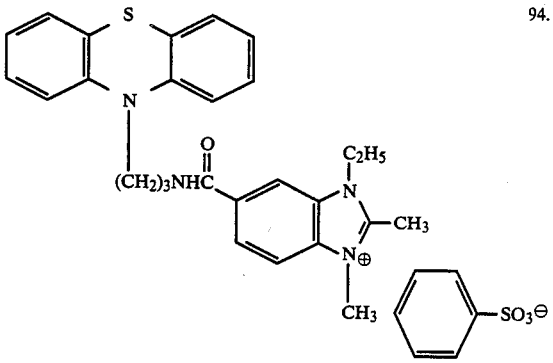

95.

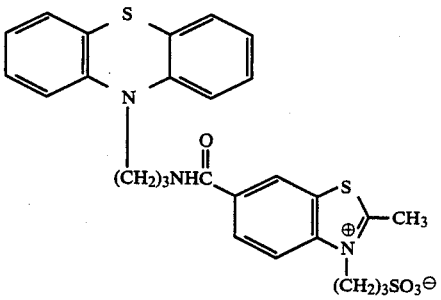

96.

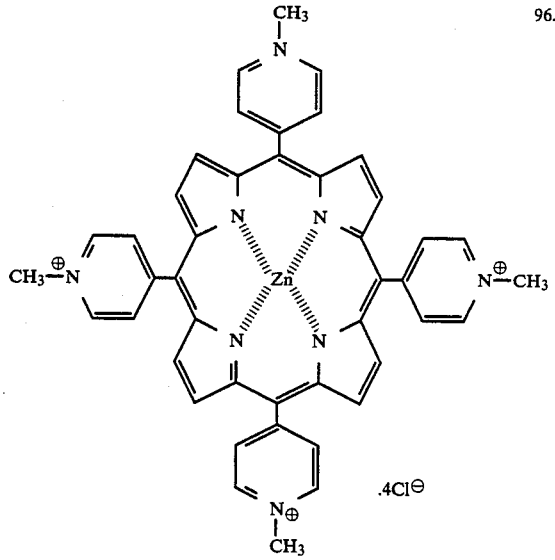

Typical examples of synthesis of compounds represented by formulae (I) and (II) follow. Other compounds can also be synthesized by analogy using appropriately selected known starting materials.

1. Synthesis of Compound 1

1-1. Preparation of 10-(2-Cyanoethyl)phenothiazine 4 ml of Triton B (40%) (benzyltrimethylammonium hydroxide) was dropwise added to an acetonitrile solution (200 ml) containing 199 g of phenothiazine, 106 g of acrylonitrile, and a small quantity of Irganox 1010 (made by Ciba Geigy Co.). Irganox 1010 has the formula

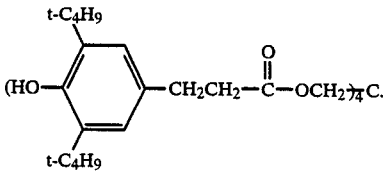

After refluxing for 3 hours while heating, 53 g of acrylonitrile was added thereto, followed by relfuxing for a further 2 hours while heating. After being allowed to cool, acetone was added to the reaction solution to crystallize the reaction product. Crystals thus formed were collected by filtration, and recrystallized from 900 ml of acetone to obtain 135 g of the desired compound. m.p. 158°–160° C.

1-2. Preparation of 10-(3-Aminopropyl)phenothiazine 96.5 g of boron trifluoride ethyl etherate was dropwise added to a dispersion of 19.7 g of sodium borohydride in 500 ml of tetrahydrofuran while ice-cooling. After stirring for 30 minutes, 94 g of the compound obtained in 1-1. was added thereto, and the reaction was conducted for 1 hour while ice-cooling and then for 3 hours at room temperature. Excess diborane was decomposed with 20 ml of water, and 250 ml of concentrated hydrochloric acid was added thereto, followed by conducting the reaction for 4 hours at 50° C. The reaction solution was rendered alkaline with an NaOH (130 g) aqueous solution, and after stirring for 5 hours at 50° C., the solution was extracted with ethyl acetate, and the extract was washed with water. After concentration, distillation of the concentrate under reduced pressure yielded 58 g of the desired compound (b.p. 215°–220° C./1 mmHg).

1-3. Preparation of 10-[3-(3-Phenylthioureido)-propyl]phenothiazine 5.1 g of the compound obtained in 1-2. was reacted with 2.8 g of phenyl isothiocyanate in 50 ml of tetrahydrofuran at room temperature for 3 hours. The reaction solution was concentrated by means of an evaporator, and the concentrate was subjected to silica gel column chromatography (developing solution: $CHCl_3$) for purification and separation, followed by recrystallization from chloroform/hexane (1:1 by volume) to obtain 3 g of the desired end product. m.p. 135°–135° C.

2. Synthesis of Compound 3

2-1. Preparation of 4-Hydroxy-4'-methoxydiphenylamine 110 g of hydroquinone, 148 g of p-anisidine, 5 g of sulfanilic acid, and 20 ml of xylene were stirred during heating using an oil bath of a temperature of 230° C. to react for 2.5 hours while removing distilled water. After being allowed to cool, the reaction product was extracted with methanol and, after removing solids by filtration, the filtrate was concentrated to obtain 168 g of the desired compound.

2-2. Preparation of 4,4'-Dimethoxydiphenylamine 168 g of the crude crystal compound obtained in 2-1. and 118 g of dimethylsulfuric acid were dissolved in 400 ml of acetone, and 40 wt% NaOH aqueous solution (NaOH 41.5 g) was dropwise added thereto while ice-cooling. After further reaction for 5 hours at room temperature, 400 ml of water was added to the reaction solution. Crystals thus precipitated were collected by filtration. Recrystallization of the product from 1 liter of ethanol gave 77 g of the desired compound.

2-3. Preparation of 3,7-Dimethyoxyphenothiazine

A mixture of 77 g of 4,4'-dimethoxydiphenylamine and 22 g of sulfur was heated to 80° C., and, after adding 0.3 g of iodine thereto, the mixture was heated using an oil bath of a temperature of 180° C. for 2 hours to react. After being allowed to cool, acetone was added thereto, and crystals formed were collected by filtration. Recrystallization from chloroform/methanol (8:1 by volume) yielded 41 g of the desired compound. m.p. 198°–200° C.

2-4. Preparation of 10-(3-Cyanoethyl)-3,7-dimethoxyphenothiazine.

12.3 g of the compound obtained in 2-3. was reacted with 150 g of acrylonitrile in acetonitrile according to 1-1. using a small amount of Irganox 1010 and 7 ml of Triton B, and the reaction product was separated and purified by silica gel column chromatography (developing solution: $CHCl_3$) and recrystallized from a mixture solvent of $CH_3OH$ and a small amount of $CHCl_3$to obtain 11.7 g of the desired compound.

m.p. 111°–113° C.

2-5. Preparation of 10-(3-Aminopropyl)-3,7-dimethoxyphenothiazine 6.2 g of the compound obtained in 2-4. was reduced with $NaBH_4$—$BF_3O(C_2H_5)_2$ (1.1 g/5.2 g) according to the process described in 1-2. to obtain 6.2 g of the desired compound.

2-6. Preparation of 3,7-Dimethoxy-10-[3-(3-phenylthioureido)propyl]phenothiazine 1.6 g of the compound obtained in 2-5. and 0.68 g of phenyl isothiocyanate were reacted with each other in 10 ml of acetonitrile at room temperature for 5 hours, and the reaction product was separated and purified through silica gel column chromatography (developing solution: $CHCl_3$) to obtain 1.8 g of the desired Compound 3 in a glassy state (softening point: about 70° C., liquefaction temperature: about 105° C.).

3. Synthesis of Compound 12

40% NaOH aqueous solution (NaOH 1.3 g) was added to a dispersion of 7.7 g of 10-(3-aminopropyl)-phenothiazine and 7.0 g of S-(thiobenzoyl)thioglycolic acid in 150 ml of tetrahydrofuran during stirring at room temperature, and the reaction was further conducted for 5 hours at room temperature. Water was added to the reaction solution, and the solution was extracted with ethyl acetate. After concentrating the extract, the concentrate was subjected to silica gel column chromatography for separation and purification (using $CHCl_3$ as a developing solution). Recrystallization of the product from a $CHCl_3$-hexane mixture yielded 8.1 g of the desired compound. m.p. 111°–113° C.

4. Synthesis of Compound 15

6.1 g of 10-(3-aminopropyl)phenothiazine and 6.5 g of thiazolidino[2,3-b]benzothiazolium bromide were dispersed in 50 ml of dimethylformamide (DMF), and, while stirring at room temperature, 3.6 ml of triethylamine was added dropwise thereto. After reacting at 60° C. for 3 hours, water was added to the reaction solution, followed by extraction with ethyl acetate. The extract was washed with water, concentrated, and subjected to silica gel column chromatography for separation and purification using $CHCl_3$ as a developing solution. Thus, there was obtained 5.7 g of the desired compound in an oily state.

5. Synthesis of Compound 16

5.1 g of 10-(3-aminopropyl)phenothiazine and 3.3 g of benzothiazole-5-carboxylic acid were dissolved in a solvent mixture of 50 ml of dimethylformamide and 50 ml of tetrahydrofuran, and, while stirring at room temperature, 4.3 g of dicyclohexylcarbodiimide and 0.4 g of 4-dimethylaminopyridine were added thereto. After reacting for 2 hours at room temperature and for 4 hours at 60° C., solids were removed by filtration, and water was added to the filtrate, followed by extraction with ethyl acetate and washing with water. The crude product was separated and purified by silica gel column chromatography (using as a developing solution $CHCl_3$, then a mixture of $CHCl_3$ and $CH_3OH$ (20/1 by volume)), followed by recrystallization from methanol/acetonitrile (50 ml/100 ml) to obtain 5.5 g of the desired end compound.

m.p. 150°–154° C. (decomposition point).

6. Synthesis of Compound 18

1.6 g of 10-(3-aminopropyl)-3,7-dimethoxyphenothiazine and 1.1 g of 1-(3-carboxyphenyl)-5-mercaptotetrazole were dissolved in a solvent mixture of 5 ml of dimethylformamide and 10 ml of tetrahydrofuran. 1.0 g of dicyclohexylcarbodiimide and 0.1 g of 4-dimethylaminopyridine were added thereto, and reaction was conducted at room temperature for 4 hours. After-treatment was conducted in the same manner as in Synthesis Example 5. After separation and purification by silica gel column chromatography using $CHCl_3$, then a mixture of $CHCl_3$ and $CH_3OH$ (50/1–10/1 by volume) as a developing solution, the product was recrystallized from $CHCl_3$/hexane (1/1 by volume) to obtain 1.4 g of the desired compound. m.p. 174°–175° C. (decomposition).

7. Synthesis of Compound 19

In a manner analogous to the process described in Synthesis Example 6, except using 3.8 g of 10-(3-aminopropyl)phenothiazine and 3.1 g of 2-carboxymethylthio-5-mercapto-1,3,4-thiadiazole, there was obtained 4.2 g of the desired end compound 4.2 g. of m.p. 164°–166° C.

8. Synthesis of Compound 28

5.1 g of 10-(3-aminopropyl)phenothiazine and 3.1 ml of triethylamine were dissolved in a solvent mixture of 20 ml of methanol and 15 ml of tetrahydrofuran, and, under cooling with ice, 1.7 g of carbon disulfide was added dropwise thereto. After stirring the mixture at room temperature for 3 hours, 3.7 g of ethyl bromoacetate was added dropwise thereto, followed by reacting for further 3 hours at room temperature. Water was added to the reaction product, and, after removing the aqueous layer by decantation, the resulting oily product was separated and purified by silica gel column chromatography using $CHCl_3$/hexane as a developing solution to obtain 6.4 g of the desired oily compound.

9. Synthesis of Compound 33

9-1. Preparation of 10-(3-Isothiocyanatopropyl)-phenothiazine 4.2 g of carbon disulfide was added dropwise to a solution of 12.8 g of 10-(3-aminopropyl)phenothiazine and 7.7 ml of triethylamine in 100 ml of tetrahydrofuran. After stirring the solution at room temperature for 2 hours, a solution of 11.3 g of dicyclohexylcarbodiimide in 20 ml of tetrahydrofuran was added dropwise thereto, and the reaction was conducted at room temperature for 5 hours. After concentration, ethyl acetate was added to the concentrate, and the crystals precipitated were collected by filtration, and the filtrate was concentrated to obtain 18.6 g of the desired compound (oily).

9-2. Preparation of 1-Acetyl-4-(3-phenothiazinopropyl)thiosemicarbazide 7.3 g of 10-(3-isothiocyanatopropyl)phenothiazine was reacted with 1.5 g of acetylhydrazine in 30 ml of tetrahydrofuran for 3 hours by refluxing under heating, and the product was separated and purified through silica gel column chromatography (using a mixture of $CHCl_3$ and $CH_3OH$ (50/1 by volume) as a developing solution, and recrystallization from $CH_2Cl_2$ to obtain 2.5 g of the desired compound. m.p. 188°–190° C.

10. Synthesis of Compound 34

2.2 g of 10-(3-aminopropyl)phenoxazine, prepared from phenoxazine and acrylonitrile in an analogous manner to Synthesis Example 1, was reacted with 1.5 g of phenyl isothiocyanate in 25 ml of acetonitrile at room temperature. The product was purified through silica gel column chromatography using a mixture of $CHCl_3$ and hexane (4/1 by volume) as a developing solution and recrystallization from $CHCl_3$/hexane (1/1 by volume) to obtain 2.5 g of the desired compound. m.p. 118°–120° C.

11. Synthesis of Compound 41

16.8 g of 3-amino-9-ethylcarbazole was reacted with 11.9 g of phenyl isothiocyanate in 90 ml of tetrahydrofuran at room temperature for 3 hours, and 300 ml of methanol was added thereto. Crystals thus precipitated were collected by filtration, dissolved in 50 ml of dimethylformamide, and filtered. Then, 250 ml of methanol was added to the filtrate to recrystallize. Thus, there was obtained 15.0 g of the desired end product. m.p. 179°–180° C.

12. Synthesis of Compound 43

16.8 g of 3-amino-9-ethylcarbazole and 13.0 g of benzotriazole-5-carboxylic acid were treated with 18.2 g of dicyclohexylcarbodiimide and 2 g of 4-dimethylaminopyridine in a mixed solution of 30 ml of dimethylformamide and 120 ml of tetrahydrofuran in an analogous manner to Synthesis Example 5, followed by recrystallization from $CH_3OH$/acetone to obtain 8.5 g of the desired end compound. m.p. 186°–190° C.

13. Synthesis of Compound 44

4.2 ml of triethylamine was added to a solution of 6.3 g of 3-amino-9-ethylcarbazole and 8.2 g of thiazolino[2,3-b]benzothiazolium bromide in 100 ml of dimethylformamide and, after reacting for 3 hours at 50° C., 200 ml of methanol and 50 ml of water were added thereto. Crystals thus precipitated were collected by filtration, then recrystallized from dimethylformamide/acetonitrile (400 ml/400 ml) to obtain 7.5 g of the desired end compound. m.p. 208°–210° C.

14. Synthesis of Compound 45

1-(3-Carboxyphenyl)-5-mercaptotetrazole and 4.2 ml of triethylamine were dissolved in 30 ml of tetrahydrofuran and, while stirring under ice-cooling, 3.3 g of ethyl chloroformate was added dropwise thereto. After reacting for 2 hours at room temperature, 3.2 g of 3-amino-9-ethylcarbazole was added thereto, followed by reacting for further 3 hours at room temperature. Then, 15% KOH aqueous solution (KOH 1.9 g) was added to the reaction solution and, after stirring at 50° C. for 2 hours, it was neutralized with 2.9 ml of hydrochloric acid, and extracted with ethyl acetate. The extract was washed with water, concentrated, and recrystallized from $CHCl_3$/$CH_3OH$ (3/1 by volume) to obtain 1.6 g of the desired end compound. m.p. 199°–200° C. (decomposition).

15. Synthesis of Compound 57

15-1. Preparation of 9-Ethyl-3-isocyanatocarbazole 38.6 g of 3-amino-9-ethylcarbazole and 27.9 ml of triethylamine were added to 300 ml of methanol, and, while cooling with ice, 15.2 g of carbon disulfide was added dropwise thereto. After conducting reaction at room temperature for 3 hours, 41.3 g of dicyclohexylcarbodiimide was added thereto, followed by reacting at room temperature for 4 hours. Crystals thus precipitated were collected by filtration, heat-refluxed in 500 ml of ethyl acetate, and cooled to precipitate and then filter off solids. The filtrate was concentrated to obtain the desired product (29 g).

15-2. Preparation of 1-Acetyl-4-(9-ethyl-3-carbazolyl)thiosemicarbazide 3.8 g of 9-ethyl-3-isothiocyanatocarbazole was reacted with 1.1 g of acetylhydrazine in 30 ml of tetrahydrofuran at 60° C. for 2 hours. Then, 10 ml of methanol was added thereto and crystallization was conducted while cooling with ice. Crystals thus precipitated were collected by filtration, and recrystallized from $CHCl_3/CH_3OH$ (70 ml/200 ml) to obtain 2.4 g of the desired end compound. m.p. 197°–199° C.

16. Synthesis of Compound 47

1.7 g of Compound 57 was reacted with 2.4 g of a 28% $CH_3ONa$ methanol solution in 30 ml of methanol by refluxing while heating for 2 hours. Then, 0.9 ml of acetic acid was added to the reaction solution, and crystallization was conducted while cooling with ice. Crystals thus precipitated were collected by filtration and recrystallized from $CHCl_3/CH_3OH$ (3/1 by volume) to obtain 1.4 g of the desired end compound. m.p. 267°–269° C.

17. Synthesis of Compound 54

2.1 ml of triethylamine was added dropwise to a dispersion of 3.8 g of 9-ethyl-3-isothiocyanatocarbazole and 2.1 g of glycine ethyl ester hydrochloride in 20 ml of ethanol. After reacting at room temperature for 2 hours, 15 ml of 1N NaOH was added thereto, followed by heat refluxing for 5 hours. After being allowed to cool, 0.9 ml of acetic acid was added thereto, then water was added thereto. Crystals thus precipitated were collected by filtration and recrystallized from $CHCl_3/CH_3OH$ (3/1 by volume) to obtain 1.0 g of the desired end compound. m.p. 255°–257° C. (decomposition).

18. Synthesis of Compound 59

4.5 g of 9-(3-aminopropyl)carbazole, synthesized from carbazole and acrylonitrile in an analogous manner to Synthesis Example 1, was reacted with 2.8 g of phenyl isothiocyanate in 50 ml of tetrahydrofuran at 50° C. for 5 hours. Then, 200 ml of methanol was added thereto, and the crystals thus precipitated were collected by filtration. Recrystallization of the crystals from $CHCl_3$/ethanol (20 ml/60 ml) gave 2.4 g of the desired end compound. m.p. 135°–136° C.

19. Synthesis of Compound 65

1.5 g of 1-aminopyrene and 1.0 g of phenyl isothiocyanate were reacted with each other in 15 ml of acetonitrile, and the crystals precipitated were collected by filtration and recrystallized from dimethylformamide-acetonitrile (15 ml/40 ml) to obtain 1.6 of the desired end product. m.p. 194°–195° C.

20. Synthesis of Compound 66

1.5 g of 1-aminopyrene was reacted with 1.9 g of thiazolino[2,3-b]benzothiazolium bromide in an analogous manner to Synthesis Example 4, and then reaction product was purified through silica gel column chromatography using $CHCl_3$ as a developing solution to obtain 0.4 g of the desired end compound. m.p. 130°–145° C.

21. Synthesis of Compound 67

15.5 g of 9-aminoacridine was reacted with 11.9 g of phenyl isothiocyanate, and the reaction product was re-precipitated to obtain 4.1 g of the desired compound. m.p. 190°–191° C.

22. Synthesis of Compound 71

22-1. Preparation of 4'-Methoxy-4-nitrochalcone 30 g of p-nitrobenzaldehyde was reacted with 30 g of p-methoxyacetophenone in 200 ml of acetic acid in the presence of 34 ml of sulfuric acid at room temperature for 1 day, and the reaction mixture was poured into 1 liter of ice-water. After neutralizing the mixture with 48 g of NaOH, cyrstals formed were collected by filtration, and recrystallized from acetoneacetonitrile (0.2 liter/1.3 liter) to obtain 37.6 g of the desired compound. m.p. 171°–173° C.

22-2. Preparation of 3-(4-Methoxyphenyl)-5-(4-nitrophenyl)-1-phenyl-2-pyrazoline 14.2 g of 4'-methoxy-4-nitrochalcone was reacted with 5.4 g of phenylhydrazine in 100 ml of ethanol in the presence of 5 ml of hydrochloric acid by refluxing while heating for 6 hours. After neutralizing the reaction mixture with 50 ml of 1N NaOH, 400 ml of water was added thereto. Decantation-water washing was repeated three times. Crystals formed were recrystallized from 200 ml of acetone to obtain 14.7 g of the desired compound. m.p. 168°–173° C.

22-3. Preparation of 5-(4-Aminophenyl)-3-(4-methoxyphenyl)-1-phenyl-2-pyrazoline 15.8 g of reduced iron and 1.6 g of ammonium chloride were dispersed in a mixed solution of 140 ml of isopropyl alcohol and 14 ml of water, and, while stirring and refluxing under heating, 13.1 g of 3-(4-methoxyphenyl)-5-(4-nitrophenyl)-1 -phenyl-2-pyrazoline was added thereto. After refluxing for 2 hours, 10 ml of acetic acid was added thereto, and the reaction was thereafter continued for 30 minutes. Solids were removed by filtration using sellaite, and 150 ml of water was added to the filtrate. Crystals precipitated were collected by filtration to obtain 9.7 g of 5-(4-aminophenyl)-3-(4-methoxyphenyl)-1-phenyl-2-pyrazoline.

m.p. 164°–166° C.

22-4. Preparation of 3-(4-Methoxyphenyl)-5-[4-(3-phenylthioureido)phenyl]-1-phenyl-2-pyrazoline 3.4 g of 5-(4-aminophenyl)-3-(4-methoxyphenyl)-1-phenyl-2-pyrazoline and 1.5 g of phenyl isothiocyanate were reacted with each other in acetonitrile, and the product was reprecipitated from dimethylformamidemethanol to obtain 2.7 g of the desired end compound.

m.p. 153°–156° C.

23. Synthesis of Compound 74

23-1. Preparation of 4,4'-Dimethylamino-2,2'-dimethyl-4''-nitrotriphenylmethane

A mixture of 66.4 g of N,N-dimethyl-m-toluidine, 30.2 g of p-nitrobenzaldehyde, 18.4 ml of hydrochloric acid, and 5 ml of ethanol was refluxed under heating to react for 3 hours. After cooling the reaction solution, the product was recrystallized from 3 liters of acetone to obtain 62 g of the desired compound. m.p. 231°–233° C.

23-2. Preparation of 4''-Amino-4,4'-dimethylamino-2,2'-dimethyltriphenylmethane 20.2 g of 4,4'-dimethylamino-2,2'-dimethyl-4''-nitrotriphenylmethane was reduced with 22.5 g of reduced iron and 2.3 g of ammonium chloride, and the product was extracted with ethyl acetate to obtain 21.2 g of the desired compound. m.p. 148°–150° C.

23-3. Preparation of 4,4'-Dimethylamino-2,2'-dimethyl-4''-(3-phenylthioureido)triphenylmethane 7.1 g of 4''-amino-4,4'-dimethylamino-2,2'-dimethyltriphenylmethane was reacted with phenyl isothiocyanate in an equimolar amount, and the reaction product was purified through silica gel column chromatography (using a mixture of $CHCl_3$ and ethyl acetate (10/1 by volume) as a developing solution) to obtain 5.0 g of the desired end compound. m.p. 114°–116° C.

As the silver halide composition of internal latent image-forming silver halide emulsion of the present invention, silver bromide, silver iodide, silver chloride, silver chlorobromide, silver bromoiodide, silver chlorobromoiodide, etc., may, for example, be used. Preferable silver halide emulsions contain at least 50 mol% silver bromide, and contain preferably not more than about 10 mol% (including 0 mol%) silver iodide. As to the crystal form of silver halide grains, any crystal form, including plate-like grains having 5 or more of aspect ratio as described in *Research Disclosure,* No. 22534, January (1983) and in Japanese Patent Application (OPI) No. 108528/83 may be usable, with regular grains in octahedral form being preferable. Multivalent metal ion (such as Cu, Cd or Pb ion) may be doped in the shell of the silver halide grains to improve photographic properties as described in U.S. Pat. No. 4,395,478. Further, an internal latent image-forming direct positive emulsion having one or more kinds of metal elements other than Ag (such as Au, Cu, Cd, Pb, Rh, Ru, Ir and Os) in the silver halide grains (inside the core or surface of the core) may be usable.

The internal latent image-forming emulsion can be clearly defined by the fact that it provides greater maximum density when developed with an "internal" developing solution than it provides when developed with a "surface" developing solution.

Internal latent image-forming silver halide emulsions suited for the present invention are those which, when coated on a transparent support, exposed for a definite time of 0.01 to 1 second, and developed in the developer A (internal developer) as described below at 20° C. for 3 minutes, provide a maximum density (measured according to an ordinary photographic density-measuring method) of at least five times as much as the maximum density obtained by exposing them in the same manner and developing in the developer B (surface developer) as described below at 20° C. for 4 minutes. Preferable emulsions are those which provide, when developed in developer A, a maximum density more than 10 times that obtained by developing them in developer B.

Developer A

| | |
|---|---|
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 liter |

Developer B

| | |
|---|---|
| p-Hydroxyphenylglycine | 10 g |
| Sodium Carbonate | 100 g |
| Water to make | 1 liter |

As the internal latent image-forming silver halide emulsions to which the present invention is applicable, there are illustrated, for example, conversion emulsions obtained by a process of converting silver salt grains with high solubility such as silver chloride to silver salt grains with low solubility such as silver (iodo)bromide (a process of catastrophic precipitation), as described, for example, in U.S. Pat. No. 2,592,250; core/shell emulsions containing silver halide grains comprising core particles coated with a silver halide shell, prepared by mixing a core emulsion containing chemically sensitized large silver halide grains with a fine grained emulsion and ripening the resulting mixture, as described, for example, in U.S. Pat. No. 3,206,313; core/shell emulsions containing silver halide grains comprising core particles coated with a silver halide shell, prepared by adding, to a chemically sensitized monodisperse core emulsion, a solution of soluble silver salt and a solution of soluble halide at the same time, while keeping the silver ion concentration at a constant level, as described, for example, in British Pat. No. 1,027,146 and U.S. Pat. No. 3,761,276; halide-localized emulsions containing silver halide grains of two or more layered structure wherein one layer is different from another in halide composition, as described, for example, in U.S. Pat. No. 3,935,014; and emulsions containing foreign metals, prepared by producing silver halide grains in an acidic medium containing a trivalent metal ion, as described, for example, in U.S. Pat. No. 3,447,927. In addition, there are internal latent image-forming emulsions which are prepared according to processes as described in E. J. Wall, *Photographic Emulsions,* pp. 35–36 and 52–53, American Photographic Publishing Co. (1929), and U.S. Pat. Nos. 2,497,875, 2,563,785, 3,511,662, West German Patent Application (OLS) No. 2,728,108, etc. Of the above-described internal latent image-forming emulsions, core/shell type emulsions are particularly suited for application of the present invention.

Typical nucleating agents for internal latent image-forming emulsions include hydrazines as described in U.S. Pat. Nos. 2,563,785 and 2,588,982, hydrazides and hydrazones as described in U.S. Pat. No. 3,227,552, hetero ring quaternary salt compounds as described in British Pat. No. 1,283,835, Japanese Patent Application (OPI) No. 69613/77, U.S. Pat. Nos. 3,615,615, 3,719,494, 3,734,738, 4,094,683, 4,115,122, etc., sensitizing dyes having nucleating substituents in the dye molecules as described in U.S. Pat. No. 3,718,470, thiourea-bound acylhydrazine compounds as described in U.S. Pat. Nos. 4,030,925, 4,031,127, 4,245,037, 4,255,511, 4,266,013 and 4,276,364, British Pat. No. 2,012,443, etc., and acylhydrazine compounds having a thioamido ring or a hetero ring such as a triazole or tetrazole as an adsorptive group as described in U.S. Pat. Nos. 4,080,270, 4,278,748, British Pat. No. 2,011,391B, etc.

The nucleating agents are desirably used in amounts adequate to provide sufficient maximum density when internal latent image-forming emulsions containing them are developed in a surface developer. Practically, the amounts vary depending upon characteristic properties of silver halide emulsion, chemical structure of the nucleating agents, and developing conditions, thus the proper amounts being in a wide range. In the case of adding them to a developing solution, they are used generally in amounts of from about 1 mg to about 5 g (and preferably from 5 mg to 0.5 g) per liter of the developing solution, whereas in the case of adding to an emulsion layer, amounts of from about 0.01 mg to about 5 g per mol of silver in an internal latent image-forming emulsion are particularly useful, with from about 0.05 mg to about 0.5 g per mol of silver being more preferable. In the case of incorporating them in a hydrophilic colloid layer adjacent to the emulsion layer, they may be incorporated in about the same amounts as described above based on the amount of silver coated in the same area of the internal latent image-forming emulsion layer.

In the light-sensitive material of the present invention, the photographic emulsions may be spectrally sensitized to blue light of comparatively long wavelength, green light, red light or infrared light using sensitizing dyes. As the sensitizing dyes, cyanine dyes, merocyanine dyes, complex cyanine dyes, complex merocyanine dyes, holopolar cyanine dyes, styryl dyes, hemicyanine dyes, oxonol dyes, hemioxonol dyes, etc., may be used. These sensitizing dyes include cyanine dyes and merocyanine dyes as described, for example, in Japanese Patent Application (OPI) Nos. 40638/84, 40636/84 and 38739/84. Further, specific examples of the spectrally sensitizing dyes are described in, for example, P. Glafkides, *Chimie Photographique* (2nd Ed., 1957, Paul Montel, Paris), chapters 35–41 and F. M. Hamer, *The Cyanine and Related Compounds* (Interscience), and U.S. Pat. Nos. 2,503,776, 3,459,553, 3,177,210, etc.

In the present invention, the sensitizing dyes are used in the same concentration as in ordinary negative working silver halide emulsions. Particularly, it is advantageous to use them in a concentration not substantially decreasing intrinsic sensitivity of silver halide emulsion. Specifically, they are preferably used in concentrations of from about $1.0\times10^{-5}$ to about $5\times10^{-4}$ mol, and more preferably from $4\times10^{-5}$ to $2\times10^{-4}$ mol, per mol of silver halide.

In the light-sensitive material of the present invention color image-forming couplers may also be incorporated. Otherwise, the light-sensitive material may be developed with a developer containing color image-forming couplers.

The photographic emulsion to be used in the present invention may be combined with a dye image-providing compound (color material) for a color diffusion transfer process capable of releasing a diffusible dye corresponding to development of silver halide to obtain a desired transferred image in an image-receiving layer after proper development processing. As such color materials for color diffusion transfer process, many compounds are known. For example, such compounds are described in U.S. Pat. Nos. 3,227,551, 3,227,554, 3,443,939, 3,443,940, 3,443,930, 3,443,943, 3,628,952, 3,844,785, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, 4,013,635, 4,053,312, 4,055,428, 4,268,625 and 4,336,322, U.S. Patent Publication B No. 351,673, British Pat. Nos. 840,731, 904,364 and 1,038,331, West German Patent Applications (OLS) Nos. 1,930,215, 2,214,381, 2,228,361, 2,317,134, 2,402,900, French Pat. Nos. 2,284,140, Japanese Patent Application (OPI) Nos. 46730/78, 130122/79, 16130/81, 650/82, 4043/82, 104343/76, Japanese Patent Application (OPI) Nos. 12642/81, 143323/78, etc., may be used. Of these, color materials of the type which are essentially non-diffusible, but, upon oxidation reduction reaction with an oxidation product of a developing agent (or an electron donor), undergo cleavage to release a diffusible dye (hereinafter abbreviated as DRR compounds) are preferable. DRR compounds having an N-substituted sulfamoyl group are particularly preferable. These color materials are suitably used in amounts of from $1\times10^{-4}$ to $1\times10^{-2}$ mol/m$^2$, with $2\times10^{-4}$ to $2\times10^{-3}$ mol/m$^2$ being more preferable.

Various photographic supports may be used in the light-sensitive material of the present invention. The silver halide emulsion may be coated on one side or both sides of the support.

In the light-sensitive material of the present invention, the silver halide emulsion layers and other hydrophilic layers may contain other additives, particularly additives useful for photographic emulsions, such as lubricants, stabilizers, hardeners, sensitizing agents, light absorbents, plasticizers, etc.

Further, in the present invention, silver halide emulsions may contain compounds capable of releasing iodide ion (for example, potassium iodide), or desired images may be obtained by using a developer containing iodide ion.

Various known developing agents may be used for developing the light-sensitive material of the present invention. That is, polyhydroxybenzenes such as hydroquinone, 2-chlorohydroquinone, 2-methylhydroquinone, catechol, pyrogallol, etc.; aminophenols such as p-aminophenol, N-methyl-p-aminophenol, 2,4-diaminophenol, etc.; 3-pyrazolidones such as 1-phenyl-3-pyrazolidone, 4,4-dimethyl-1-phenyl-3-pyrazolidone, 4,4-dihydroxymethyl-1-phenyl-3-pyrazolidone, 4-methyl-4-hydroxymethyl-1-phenyl-3-pyrazolidone, 4-methyl-4-hydroxymethyl-1-p-tolyl-3-pyrazolidone, etc.; ascorbic acids; etc., may be used, alone or in combination. In order to obtain color images from dye-forming couplers, aromatic primary amine developing agents, preferably p-phenylenediamine type developing agents, may be used. Specific examples thereof include 4-amino-3-methyl-N,N-diethylaniline hydrochloride, N,N-diethyl-p-phenylenediamine, 3-methyl-4-amino-N-ethyl-N-β-(methanesulfoamido)ethylaniline, 3-methyl-4-amino-N-ethyl-N-(β-sulfoethyl)aniline, 3-ethoxy-4-amino-N-ethyl-N-(β-sulfoethyl)aniline, 4-amino-N-ethyl-N-(β-hydroxyethyl)aniline, etc. Such developing agents may be incorporated in an alkaline processing composition (processing element) or in a proper layer of light-sensitive material.

In using DRR compounds in the present invention, any silver halide developing agent (or electron donor) may be used that can cross-oxidize the DRR compounds, with 3-pyrazolidones being particularly preferable.

The developer may contain, as a preservative, sodium sulfite, potassium sulfite, ascorbic acid, reductones (e.g., piperidinohexose reductone), etc.

When developed in a surface developer, the light-sensitive material of the present invention can provide a direct positive image. The surface developer is a developer with which development is substantially induced by latent image or fogging nuclei on the surface of silver halide grains. The developer preferably contains no silver halide solvents. However, silver halide solvents (for example, sulfites) may be contained in small amounts as long as the internal latent image does not substantially exert any influence until development by surface development centers on the silver halide grains is completed.

The developer may contain sodium hydroxide, potassium hydroxide, sodium carbonate, potassium carbonate, trisodium phosphate, sodium metaborate, etc., as alkali agents and buffering agents. These agents are used in such amounts that pH of a resulting developer becomes not less than 10 to 14, preferably 12 to 14. In addition, the developer advantageously contains benzimidazoles such as 5-nitrobenzimidazoles, benzotriazoles such as benzotriazole, 5-methylbenzotriazole, etc., for lowering minimum density of direct positive image, which are usually used as antifoggants. Furthermore, the developer advantageously contains a color development accelerator such as benzyl alcohol.

The light-sensitive material of the present invention is preferably processed with a viscous developer. This viscous developer is a liquid composition containing processing ingredients necessary for developing a silver halide emulsion and for formation of diffusion transfer dye image. A major component of the solvent is water and, in some cases, hydrophilic solvents such as methanol and methyl Cellosolve are contained. The processing composition contains an amount of alkali sufficient to keep the pH at a level necessary for causing development of the emulsion layer and sufficient to neutralize acids produced during the steps of development and dye image formation (for example, hydrohalogenic acids such as hydrobromic acid, carboxylic acids such as acetic acid, etc.). As the alkali, lithium hydroxide, sodium hydroxide, potassium hydroxide, calcium hydroxide dispersion, tetramethylammonium hydroxide, sodium carbonate, trisodium phosphate, alkali metal salts or alkaline earth metal salts of diethylamine or the like, and amines. Preferably, caustic alkali is used in an amount to provide a pH of about 12 or more at room temperature (and more preferably a pH of 13 or more). Also preferably, the processing composition contains a hydrophilic polymer such as polyvinyl alcohol, hydroxyethyl cellulose, sodium carboxymethyl cellulose, etc. These polymers are used to give the resulting composition a viscosity of 1 poise or more, and preferably a viscosity of from about 500 to 1,000 poises at room temperature.

The processing composition may contain, in addition, carbon black as light barrier for preventing silver halide emulsion from being fogged during or after photographic processing, a light absorbent such as pH-indicating dye, and a desensitizer as described in U.S. Pat. No. 3,579,333, which are particularly advantageous with mono-sheet film units. Further, development restrainers such as benzotriazole may be added to the processing composition.

The above-described processing composition is preferably retained in a rupturable container as described, for example, in U.S. Pat. Nos. 2,543,181, 2,643,886, 2,653,732, 2,723,051, 3,056,491, 3,056,492, 3,152,515, etc.

In the case of using the light-sensitive material of the present invention according to a diffusion transfer photographic process, it is preferably in a film unit form. The photographic film unit designed to be developable by passing it between a pair of juxtaposed pressure-applying members fundamentally comprises the following three elements:

(1) a light-sensitive element;
(2) an image-receiving element; and
(3) at least one support,
and if desired,
(4) processing element (i.e., a member for releasing a processing solution within a film unit such as a container rupturable by applying pressure (if desired, the compound (I) or (II) of the present invention may be incorporated in the processing solution)).

A preferable embodiment of this photographic film unit is the type wherein the elements are superposed to unify, such as disclosed in Belgian Pat. No. 757,959. According to this embodiment, an image-receiving layer, a light-reflecting layer, and a light barrier layer (for example, a $TiO_2$ layer and a carbon black layer), and a light-sensitive element comprising a plurality of silver halide light-sensitive layers associated with DRR compounds are coated, in sequence, on one transparent support, and a transparent cover sheet is superposed thereon in a face-to-face manner. A rupturable container retaining an alkaline processing composition containing an opacifying agent (e.g., carbon black) is positioned between the uppermost layer of the above-described light-sensitive layer(s) and the transparent cover sheet. A film unit of such structure is exposed through the transparent cover sheet, and, upon withdrawing the unit from a camera, the container is ruptured by pressure-applying members to uniformly spread the processing composition (containing the opacifying agent) between a protective layer on the light-sensitive layer and the cover sheet. Thus, the film unit is provided with a barrier from light, and development proceeds. The cover sheet preferably comprises a support having coated thereon a neutralizing layer and, if necessary, a neutralization rate-adjusting layer (timing layer) in this order.

Other useful layered and unified embodiments permitting to use the DRR compounds or diffusible dye-releasing couplers are described, for example, in U.S. Pat. Nos. 3,415,644, 3,415,645, 3,415,646, 3,647,487, 3,635,707, 3,594,164 and 3,993,486, British Pat. No. 1,330,524, European Pat. No. 53,328, etc.

Further, the form of the film unit may be of such type that a light-sensitive element is to be delaminated from the image-receiving element after spreading the processing composition.

The present invention involves the following preferable embodiments.

(1) A method of depressing formation of a re-reversed negative image under high illuminance exposure, which comprises incorporating a weak electron donative, adsorptive compound represented by formula (I) or (II) in a direct positive silver halide photographic light-sensitive material.
(2) A light-sensitive material according to the invention as generally described herein, wherein the compound of (I) or (II) is incorporated in a silver halide emulsion layer.
(3) A light-sensitive material according to the invention as generally described herein, wherein the direct positive silver halide is an internal latent image-forming silver halide which has not been pre-fogged.
(4) A light-sensitive material as in the above embodiment (2), wherein at least one silver halide emulsion layer contains at least one kind of silver halide grains having a mean edge length of 0.5 μm or more.
(5) A light-sensitive material according to the invention as generally described herein, wherein at least one direct positive silver halide emulsion layer constituting the light-sensitive material forms, when it does not contain a compound of formula (I) or (II), a re-reversed negative image having a maximum sensitivity of 30 or more (measured according to the following sensitivity-indicating standard) in high illuminance exposed area under the following coating, exposure and processing conditions:

Coating condition: one-layer coating on one side of a transparent support in an amount of 5.0 $Ag/m^2$ to form a direct positive black-and-white light-sensitive material in which the nucleating agent having the following formula is included in amounts adequate to provide the maximum density of a direct positive image obtained after development being 1.0 or more;

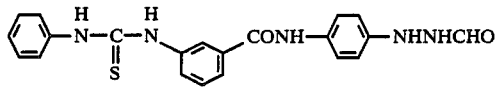

Exposure condition: 1/10,000 second exposure to white light of a color temperature of 4,800° K. on the surface of the emulsion layer using a xenon lamp as the light source;

Processing condition: developing at 20° C. for 10 minutes using a surface developer containing 0.06 wt% of 1-phenyl-3-pyrazolidone, 1.0 wt% of hydroquinone, 3.0 wt% of sodium sulfite, 4.0 wt% of sodium tertiary phosphate and 1.1 wt% of sodium hydroxide and then fixing and washing;

Negative sensitivity indication: presented as a 100-fold reciprocal of an exposure amount (cd. m.s.) giving a density of (maximum density + minimum density) × ½ of the negative image.

(6) A light-sensitive material as in the above embodiment (2), wherein the compound (I) or (II) is incorporated in the silver halide emulsion layer in an amount of from $10^{-6}$ mol to $10^{-2}$ mol per mol of silver halide in the emulsion layer.

(1) A mordant layer containing the following copolymer (3.0 g/m²) and gelatin (3.0 g/m²):

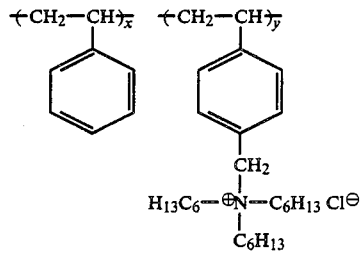

x:y = 50:50

(2) A white reflecting layer containing titanium oxide (18.0 g/m²) and gelatin (2.0 g/m²).

(3) A light barrier layer containing carbon black (2.0 g/m²) and gelatin (1.0 g/m²).

(4) A magenta color material layer containing a magenta DRR compound of the following structural formula I (0.21 g/m²), a magenta DRR compound of the structural formula II (0.11 g/m²), tricyclohexyl phosphate (0.08 g/m²), 2,5-di-tert-pentadecylhydroquinone (0.01 g/m²), and gelatin (0.9 g/m²).

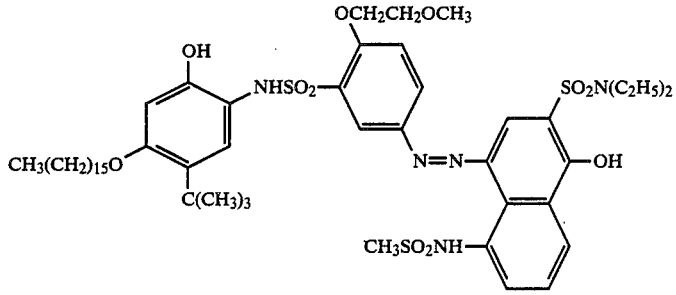

I

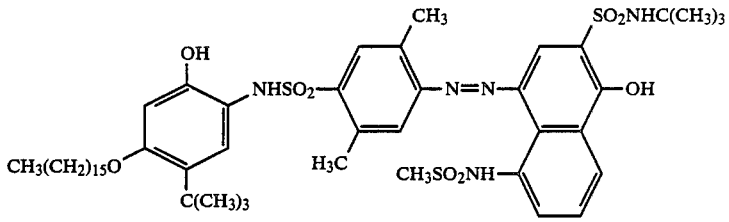

II (7) A light-sensitive material according to the invention as generally described herein, wherein the oxidation potential of the compound of (I) or (II) or of electron donative atoms D in formula (I) or (II) is from 0 to +1.0 V with respect to a saturated calomel standard electrode.

(8) A light-sensitive material according to the invention as generally described herein, wherein the compound of (I) or (II) is an adsorptive compound capable of providing electrons upon exposure.

(9) A light-sensitive material according to the invention as generally described herein, which contains a compound of formula (II) showing no spectral absorption in the region of spectral sensitization of the spectral sensitizing dye used.

EXAMPLE 1

On a polyethylene terephthalate transparent support were coated, in sequence, the following layers (1) to (6) to prepare color direct positive light-sensitive sheet (A).

(5) A green-sensitive direct positive emulsion layer containing a dye-sensitized, internal latent image-forming, octahedral silver bromoiodide (iodide content: 2 mol%) having a mean grain edge length of 1.2 μm (1.4 g Ag/m²), gelatin (1.1 g/m²), sodium 5-n-pentadecylhydroquinone-2-sulfonate (0.01 g/m²), and the following nucleating agent (0.03 mg/m²):

Nucleating Agent

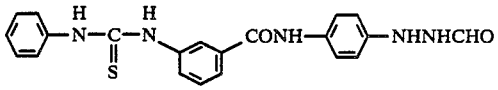

(6) A protective layer containing gelatin (1.0 g/m²).

Light-sensitive sheets (B) to (I) were obtained by adding about 0.5 mg/m² each of illustrative Compounds 1, 4, 12, 34, 41, 65, 66 and 71, respectively, to emulsion layer (5) described above.

The above-described light-sensitive sheets (A) to (I) were exposed and developed using the following processing solution and cover sheet.

Formulation of Processing Solution:

| | |
|---|---|
| 1-Phenyl-4-methyl-4-hydroxymethyl-3-pyrazolidone | 8.0 g |
| tert-Butylhydroquinone | 0.1 g |
| 5-Methylbenzotriazole | 2.5 g |
| Benzyl Alcohol | 1.5 ml |
| Sodium Sulfite (anhydrous) | 1.5 g |
| Zinc Nitrate (6 hydrate) | 0.4 g |
| Carboxymethyl Cellulose Na Salt | 61 g |
| Carbon Black | 410 g |
| Potassium Hydroxide | 56 g |
| Water | 260 ml (1 N as KOH concentration) |

Cover Sheet:

A cover sheet was prepared by coating on a polyethylene terephthalate support polyacrylic acid (viscosity as a 10% by weight aqueous solution: about 1,000 cps) (15 g/m$^2$) as an acidic polymer layer (neutralizing layer) and, thereon, acetyl cellulose (hydrolysis of 100 g of the cellulose yields 39.4 g of acetyl group) (3.8 g/m$^2$) and styrene/maleic anhydride copolymer (molar composition ratio: styrene/maleic anhydride=about 60:40; molecular weight: about 50,000) (0.2 g/m$^2$) as neutralization timing layer.

Exposure and Processing Step:

The above-described cover sheet was superposed on each of the aforesaid light-sensitive sheets, and "a pressure-rupturable container" retaining 0.8 g of the processing solution was inserted at one end of the sheet. Each of the thus obtained light-sensitive units was flash-exposed through a continuous wedge from the cover sheet side for 1/10,000 second under a maximum intensity of 107,000 lux using a xenon lamp as a light source, then the units were subjected to pressure-applying rollers for rapidly spreading the processing solution in a solution thickness of 100 μm. The exposure and spreading processing were conducted at room temperature (25° C.). One hour after the processing, the magenta color density of the image formed in the image-receiving layer was measured through the transparent support of the light-sensitive sheet using a Macbeth reflection densitometer.

In Table 1, relative sensitivities of negative images formed on the high illuminance exposure side were comparatively given with respect to materials (A) to (I) taking the sensitivity of light-sensitive material (A) as 100. Additionally in this light-sensitive system, the re-reversed negative image sensitivity of the comparative light-sensitive material (A) measured under the conditions specified in foregoing embodiment (5) was about 30.

TABLE 1

| Light-Sensitive Sheet | Illustrative Compound Added | Relative Sensitivity* of Re-reversed Negative Image |
|---|---|---|
| A (comparative) | No | 100 |
| B | 1 | 72 |
| C | 4 | 74 |
| D | 12 | 80 |
| E | 34 | 71 |
| F | 41 | 71 |
| G | 65 | 66 |
| H | 66 | 90 |

TABLE 1-continued

| Light-Sensitive Sheet | Illustrative Compound Added | Relative Sensitivity* of Re-reversed Negative Image |
|---|---|---|
| I | 71 | 85 |

*Relative values of reciprocals of exposure amounts giving a density of (maximum density + minimum density) × ½

As is clear from Table 1, the formation of a re-reversed negative image is significantly depressed by the compounds of the present invention.

EXAMPLE 2

A light-sensitive sheet (a) was prepared in the same manner as in Example 1, except for using the following green-sensitive emulsion layer (5') in place of the green-sensitive direct positive emulsion layer (5) used in Example 1.

(5') A green-sensitive direct positive emulsion layer containing dye-sensitized, octahedral, internal latent image forming silver bromide having a mean grain edge length of 1.5 μm (1.4 g Ag/m$^2$), gelatin (1.1 g/m$^2$), sodium 5-n-pentadecylhydroquinone-2-sulfonate (0.01 g/m$^2$), and the nucleating agent used in Example 1 (0.01 mg/m$^2$).

In addition, light-sensitive sheets (b) to (q) were obtained by adding about 0.4 mg/m$^2$ each of the illustrative compounds of the present invention, 1, 2, 3, 15, 16, 19, 27, 28, 33, 34, 43, 44, 59, 65, 67 and 70, respectively, to the above-described emulsion layer (5'). Light-sensitive sheets (a) to (q) were flash-exposed for 1/10,000 second and developed using the same processing solution and cover sheet as in Example 1. In Table 2, relative sensitivities of resulting negative images are comparatively shown taking that of light-sensitive material (a) as 100. Additionally in this light-sensitive system, the re-reversed negative image sensitivity of the comparative light-sensitive material (a) measured under the conditions specified in foregoing embodiment (5) was about 100.

TABLE 2

| Light-Sensitive Sheet | Illustrative Compound Added | Relative Sensitivity of Re-reversed Negative Image |
|---|---|---|
| a (comparison) | No | 100 |
| b | 1 | 60 |
| c | 2 | 60 |
| d | 3 | 59 |
| e | 15 | 90 |
| f | 16 | 80 |
| g | 19 | 95 |
| h | 27 | 80 |
| i | 28 | 90 |
| j | 33 | 76 |
| k | 34 | 79 |
| l | 43 | 95 |
| m | 44 | 95 |
| n | 59 | 63 |
| o | 65 | 60 |
| p | 67 | 62 |
| q | 70 | 66 |

It is seen from the results in Table 2 that formation of the re-reversed negative image is significantly depressed by the compounds of the present invention.

EXAMPLE 3

On a polyethylene terephthalate transparent support were coated, in sequence, the following layers to prepare a color direct positive photographic light-sensitive sheet (R).

(1) The same mordant layer (1) as in Example 1.

(2) The same white reflecting layer (2) as in Example 1.

(3) The same light barrier layer (3) as in Example 1.

(4) A layer containing the following DRR cyan compound (0.44 g/m$^2$), tricyclohexyl phosphate (0.09 g/m$^2$), 2,5-di-tert-pentadecylhydroquinone (0.008 g/m$^2$), and gelatin (0.8 g/m$^2$):

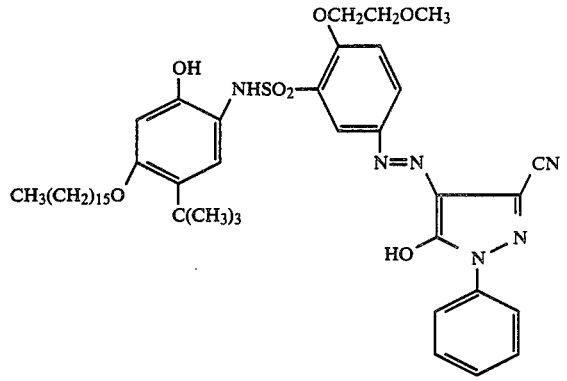

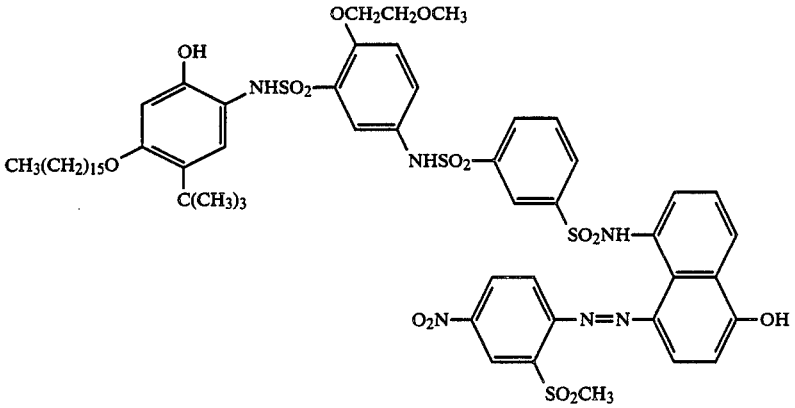

(5) A red-sensitive direct positive emulsion layer containing dye-sensitized, octahedral, internal latent image-forming silver bromide having a mean grain edge length of 1.5 μm (1.5 g Ag/m$^2$), gelatin (1.1 g/m$^2$), sodium 5-n-pentadecylhydroquinone-2-sulfonate (0.01 g/m$^2$), and the nucleating agent used in Example 1 (0.013 mg/m$^2$).

(6) An interlayer containing 2,5-di-tert-pentadecylhydroquinone (0.43 g/m$^2$), trihexyl phosphate (0.1 g/m$^2$), and gelatin (0.4 g/m$^2$).

(7) The same magenta color material layer (4) as in Example 1.

(8) A green-sensitive direct positive emulsion layer containing dye-sensitized, octahedral, internal latent image-forming silver bromide having a mean grain edge length of 1.5 μm (1.4 g Ag/m$^2$), gelatin (1.1 g/m$^2$), sodium 5-n-pentadecylhydroquinone-2-sulfonate (0.01 g/m$^2$), and the nucleating agent used in Example 1 (0.007 mg/m$^2$).

(9) The same interlayer as (6) above.

(10) A layer containing a yellow DRR compound of the following structural formula (0.53 g/m$^2$), tricyclohexyl phosphate (0.13 g/m$^2$), 2,5-di-tert-pentadecylhydroquinone (0.014 g/m$^2$), and gelatin (0.7 g/m$^2$):

(11) A blue-sensitive direct positive emulsion layer containing dye-sensitized, octahedral, internal latent image-forming silver bromide having a mean grain edge length of 1.5 μm (1.5 g silver/m$^2$), gelatin (1.1 g/m$^2$), sodium 5-n-pentadecylhydroquinone-2-sulfonate (0.002 g/m$^2$) and the nucleating agent used in Example 1 (0.024 mg/m$^2$).

(12) A protective layer containing gelatin (1.0 g/m$^2$), a hardener, etc.

Also, light-sensitive sheets (S) to (U) were prepared by adding about 0.24 mg/m$^2$ each of illustrative Compounds 65, 1 and 67 of the present invention to each of emulsion layers (5), (8), and (11) in the above-described multilayer, respectively.

The thus prepared light-sensitive sheets were flash exposed combining the processing solution and the cover sheet in Example 1, then the processing solution was spread to conduct development. Densities of the thus formed re-reversed negative images were measured. Table 3 comparatively shows the relative sensitivities of yellow, magenta and cyan colors of the re-reversed negative images.

TABLE 3

| Light-Sensitive Sheet | Illustrative Compound Added | Relative Sensitivity of Negative Image | | |
|---|---|---|---|---|
| | | Yellow | Magenta | Cyan |
| R (comparison) | None | 100 | 100 | 100 |
| S | 65 | 89 | 87 | 87 |
| T | 1 | 81 | 68 | 67 |
| U | 67 | 81 | 63 | 65 |

As is clear from the results shown in Table 3, formation of re-reversed negative image can be depressed in each of the dye image components of yellow, magenta, and cyan by the addition of the compounds of the present invention.

While the invention has been described in detail and with reference to specific embodiments thereof, it will be apparent to one skilled in the art that various changes and modifications can be made therein without departing from the spirit and scope thereof.

What is claimed is:

1. An internal latent image-forming direct positive silver halide photographic light-sensitive material wherein the direct positive silver halide is an internal latent, image-forming silver halide which has not been pre-fogged, containing a weak electron donative, adsorptive compound represented by the formula (I) or (II):

D—L—X (I)

D—X (II)

wherein L represents a linking group selected form the group consisting of alkylene group, an alkenylene group, an arylene group, —O—, —S—, —CO—, —NH— and —N= which is unsubstituted or substituted, alone of in combination;

X represents a group which is adsorptive with respect to silver halide and contains at least one of C, N, S, O and Se; and D represents an electron donative group comprising an aromatic ring or hetero ring, which is unsubstituted or substituted, having the following skeleton:

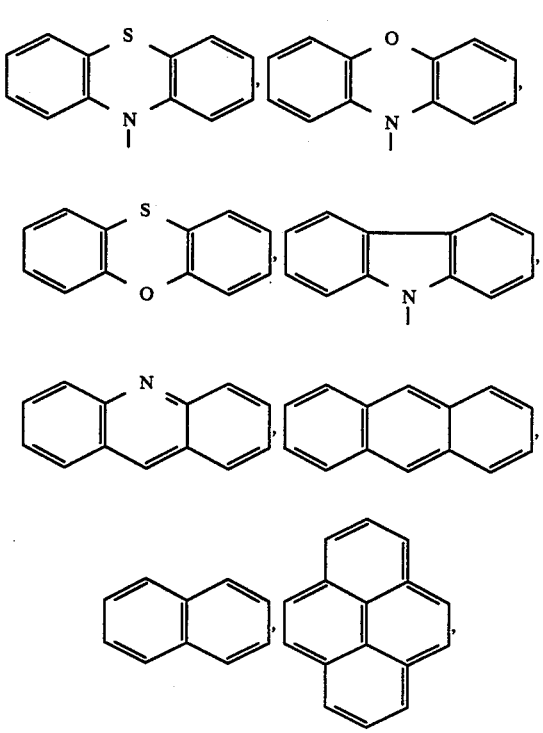

-continued

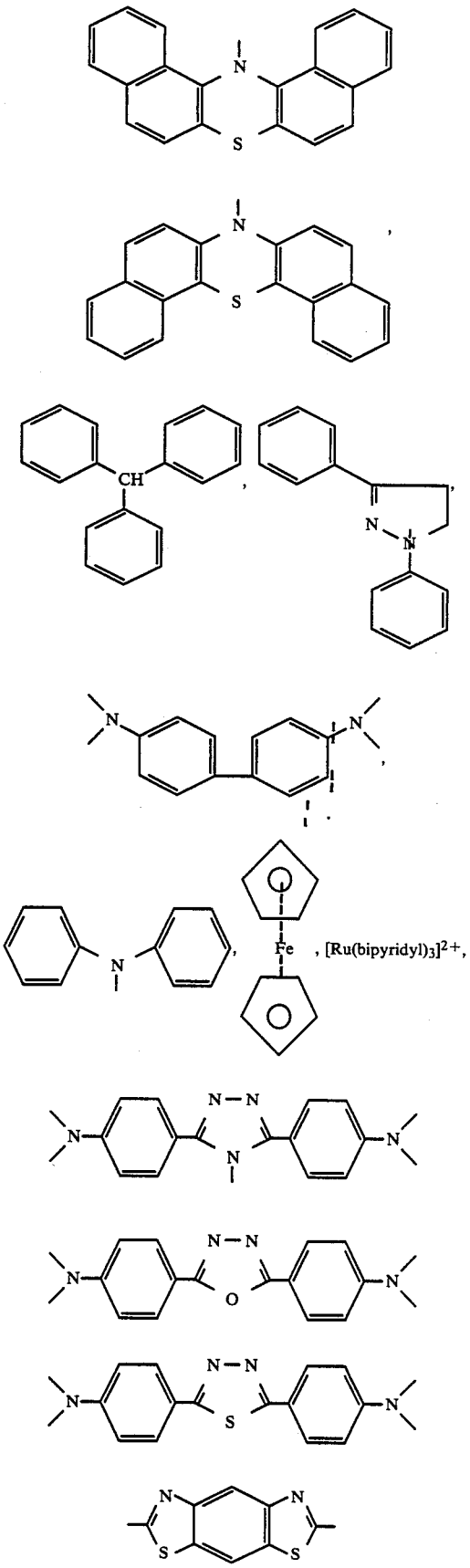

-continued

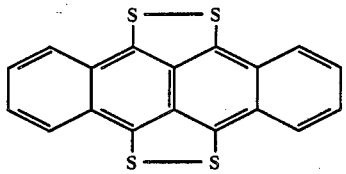

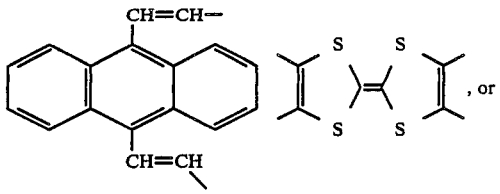

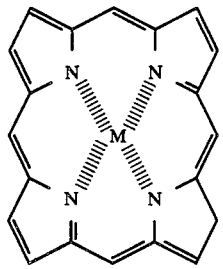

wherein M represents a heavy metal such as Zn, Pd, Cu, Ni or Fe;

said adsorptive compound represented by formula (I) of (II) being effective for depressing formation of a re-reversed negative image and not being a spectral sensitizing agent for silver halide or a nucleating agent.

2. A light-sensitive material as in claim 1, which contains the compound represented by formula (I) or (II) and a nucleating agent in combination.

3. A light-sensitive material as in claim 1, wherein X represents a group which is adsorptive with respect to silver halide and contains a quaternized N.

4. A light-sensitive material as in claim 1, wherein x represents a group derived from a thiourea, a thioamide, a mercapto-substituted hetero ring compound, a benzotriazole, a thiosemicarbazide, a rhodanine, a thiohydantoin or a thiobarbituric acid, or a mercapto group.

5. A light-sensitive material as in claim 1, wherein X is a mercapto group or a group derived from a thiourea, a thioamide, a thiosemicarbazide, or a mercapto-substituted hetero ring compound.

6. A light-sensitive material as in claim 1, wherein the compound represented by formula (I) or (II) is used in an amount of from $10^{-6}$ to $10^{-2}$ mol per mol of silver halide in an emulsion layer associated therewith.

7. A light-sensitive material as in claim 1, wherein the compound represented by formula (I) or (II) is used in an amount of from $10^{-5}$ to $10^{-3}$ mol per mol of silver halide in an emulsion layer associated therewith.

8. A light-sensitive material as in claim 1, wherein the oxidation potential of the compound of formula (I) or (II) with respect to a saturated calomel electrode is from 0 to +1.0 V.

9. A light-sensitive material as in claim 1, wherein the oxidation potential of the compound of formula (I) or (II) with respect to a saturated calomel electrode is from 0.4 to 0.7 V.

10. A light-sensitive material as in claim 1, wherein the compound of (I) or (II) is incorporated in a silver halide emulsion layer.

11. A light-sensitive material as in claim 10, wherein at least one silver halide emulsion layer contains at least one kind of silver halide grains having a mean edge length of 0.5 μm or more.

12. A light-sensitive material as in claim 1, wherein the compound of (I) or (II) is an adsorptive compound capable of providing electrons upon exposure.

13. A light-sensitive material as in claim 1, wherein the compound of formula (II) shows no spectral absorption in the region of spectral sensitization of the spectral sensitizing dye used.

14. A light-sensitizing material as in claim 2, wherein the nucleating agent is used in an amount of from 0.01 mg to 5 g per mol of silver in an internal latent image-forming emulsion associated thereiwth.

15. A light-sensitive material as in claim 2, wherein the nucleating agent is used in an amount of from 0.05 mg to 0.5 g per mol of silver in an internal latent image-forming emulsion associated therewith.

16. A light-sensitive material as in claim 1, wherein at least one direct positive silver halide emulsion layer constituting the light-sensitive material forms, when it does not contain a compound of formula (I) or (II), a re-reversed negative image having a maximum sensitivity of 30 or more (measured according to the following sensitivity-indicating standard) in high illuminance exposed area under the following coating, exposure and processing conditions:

Coating condition: one-layer coating on one side of a transparent support in an amount of 5.0 g $Ag/m^2$ to form a direct positive black-and-white light-sensitive material in which the nucleating agent having the following formula is included in amounts adequate to provide the maximum density of a direct positive image obtained after development being 1.0 or more;

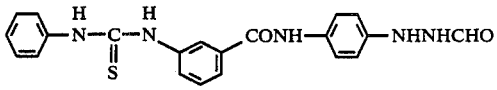

Exposure condition: 1/10,000 second exposure to white light of a color temperature of 4,800° K. on the surface of the emulsion layer using a xenon lamp as the light source;

Processing condition: developing at 20° C. for 10 minutes using a surface developer containing 0.06 wt% of 1-phenyl-3-pyrazolidone, 1.0 wt% of hydroquinone, 3.0 wt% of sodium sulfite, 4.0 wt% of sodium tertiary phosphate and 1.1 wt% of sodium hydroxide and then fixing and washing;

Negative sensitivity indication: presented as a 100-fold reciprocal of an exposure amount (cd. m.s.) giving a density of (maximum density + minimum density) × ½ of the negative image.

17. A process for depressing formation of a re-reversed negative image in an internal latent image-forming direct positive silver halide photographic light-sensitive material wherein the direct positive silver halide is an internal latent image-forming silver halide which has not been pre-fogged and which contains a weak electron donative, adsorptive compound represented by formula (I) or (II)

D—L—X (I)

D—X (II), comprising imagewise exposing and then developing the imagewise exposed photographic light-sensitive material in the presence of a nucleating agent wherein D represents an electron donative group comprising an aromatic ring or hetero ring, which is unsubstituted or substituted, having the following skeleton:

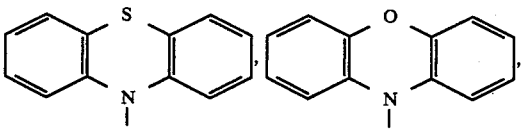

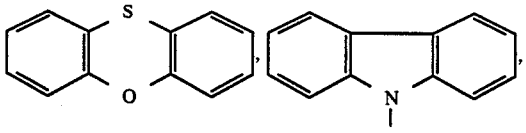

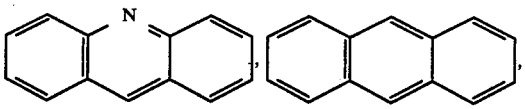

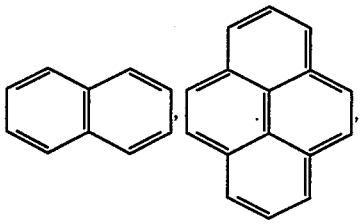

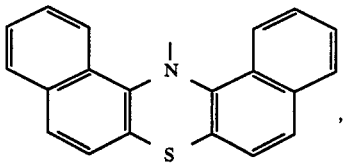

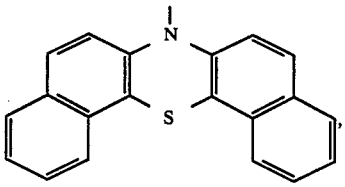

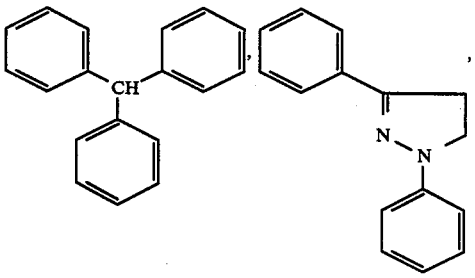

-continued

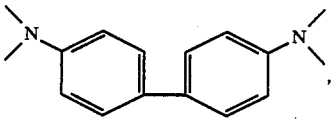

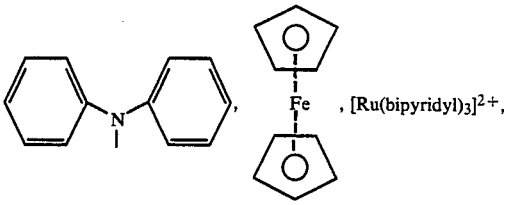

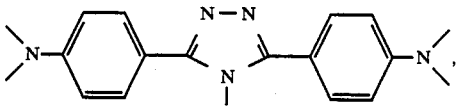

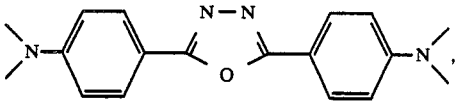

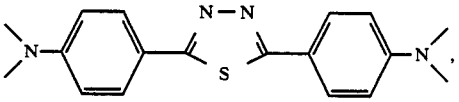

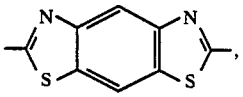

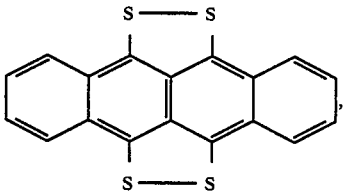

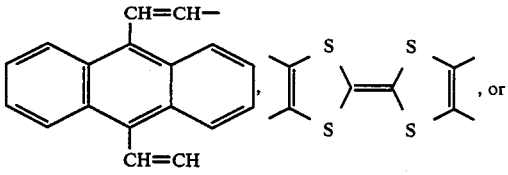

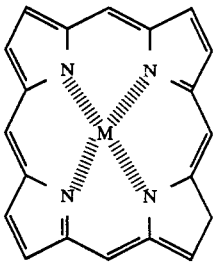

wherein

M represents a heavy metal such as Zn, Pd, Cu, Ni or Fe;

L represents a linking group selected from an alkylene group, an alkenylene group, an arylene group, —O—, —S—, —CO—, —NH— and —N= which is unsubstituted or substituted, alone or in combination; and X represents a group which is adsorptive with respect to silver halide and contains at least one of C, N, S, O and Se.

* * * * *